US009053890B2

(12) United States Patent
Sun et al.

(10) Patent No.: US 9,053,890 B2
(45) Date of Patent: Jun. 9, 2015

(54) NANOSTRUCTURE FIELD EMISSION CATHODE STRUCTURE AND METHOD FOR MAKING

(71) Applicant: University Health Network, Toronto (CA)

(72) Inventors: Yonghai Sun, North York (CA); Tze-wei Yeow, Mississauga (CA); David Anthony Jaffray, Etobicoke (CA)

(73) Assignee: University Health Network, Toronto (CA)

( * ) Notice: Subject to any disclaimer, the term of this patent is extended or adjusted under 35 U.S.C. 154(b) by 0 days.

(21) Appl. No.: 13/958,120

(22) Filed: Aug. 2, 2013

(65) Prior Publication Data

US 2015/0035428 A1 Feb. 5, 2015

(51) Int. Cl.

| | |
|---|---|
| ***H01J 1/304*** | (2006.01) |
| ***H01J 1/30*** | (2006.01) |
| ***H01J 9/02*** | (2006.01) |
| ***H01J 35/06*** | (2006.01) |

(52) U.S. Cl.

CPC ..... *H01J 9/025* (2013.01); *Y10S 977/811* (2013.01); *Y10S 977/81* (2013.01); *H01J 1/304* (2013.01); *H01J 35/065* (2013.01); *H01J 2201/3043* (2013.01); *H01J 2201/30449* (2013.01); *H01J 2201/30469* (2013.01); *H01J 2201/30496* (2013.01)

(58) Field of Classification Search

CPC ..... H01J 9/025; H01J 19/24; H01J 2201/30–2201/3048; H01J 2201/30496; H01J 2329/0407–2329/0463; H01J 2329/0473

USPC ..... 313/306, 309–310, 346, 351, 355, 313/495–497; 445/13, 35

See application file for complete search history.

(56) References Cited

U.S. PATENT DOCUMENTS

| | | | |
|---|---|---|---|
| 3,453,478 | A | 7/1969 | Shoulders et al. |
| 3,665,241 | A | 5/1972 | Spindt et al. |
| 3,755,704 | A | 8/1973 | Spindt et al. |
| 3,970,887 | A | 7/1976 | Smith et al. |
| 4,008,412 | A | 2/1977 | Yuito et al. |
| 4,874,981 | A | 10/1989 | Spindt |

(Continued)

OTHER PUBLICATIONS

P. R. Schwoebel, C. A. Spindt, C. E. Holland, J. A. Panitz, "Field emission current cleaning and annealing of microfabricated cold cathodes", in 13th International Vacuum Microelectronics Conference, 2000, pp. 980-987.

(Continued)

*Primary Examiner* — Anne Hines
*Assistant Examiner* — Jose M Diaz
(74) *Attorney, Agent, or Firm* — Bereskin & Parr LLP/S.E.N.C.R.L., s.r.l.

(57) ABSTRACT

Various embodiments are described herein for nanostructure field emission cathode structures and methods of making these structures. These structures generally comprise an electrode field emitter comprising a resistive layer having a first surface, a connection pad having a first surface disposed adjacent to the first surface of the resistive layer, and a nanostructure element for emitting electrons in use, the nanostructure element being disposed adjacent to a second surface of the connection pad that is opposite the first surface of the connection pad. Some embodiments also include a coaxial gate electrode that is disposed about the nanostructure element.

39 Claims, 11 Drawing Sheets

(56) References Cited

U.S. PATENT DOCUMENTS

| | | | | |
|---|---|---|---|---|
| 4,940,916 | A | 7/1990 | Borel et al. | |
| 5,141,459 | A | 8/1992 | Zimmerman | |
| 5,194,780 | A | 3/1993 | Meyer | |
| 5,199,917 | A | 4/1993 | MacDonald et al. | |
| 5,228,877 | A | 7/1993 | Allaway et al. | |
| 5,266,530 | A | 11/1993 | Bagley et al. | |
| 5,653,619 | A | 8/1997 | Cloud et al. | |
| 5,770,919 | A | 6/1998 | Tjaden et al. | |
| 5,795,208 | A | 8/1998 | Hattori | |
| 5,872,422 | A | 2/1999 | Xu et al. | |
| 6,010,383 | A | 1/2000 | Knall | |
| 6,277,318 | B1 | 8/2001 | Bower et al. | |
| 6,329,214 | B1 | 12/2001 | Hattori et al. | |
| 6,630,772 | B1 | 10/2003 | Bower et al. | |
| 6,692,324 | B2 | 2/2004 | Simpson et al. | |
| 6,817,916 | B2 | 11/2004 | Piehl | |
| 6,863,942 | B2 | 3/2005 | Ren et al. | |
| 6,992,324 | B2 | 1/2006 | Nagayama | |
| 7,132,304 | B2 | 11/2006 | Choi et al. | |
| 7,214,553 | B2 | 5/2007 | Legagneux et al. | |
| 7,459,839 | B2 | 12/2008 | Tolt | |
| 7,527,988 | B2 | 5/2009 | Lee et al. | |
| 7,772,755 | B2 | 8/2010 | Liu et al. | |
| 7,915,798 | B2 | 3/2011 | Liu et al. | |
| 8,102,108 | B2 | 1/2012 | Tolt | |
| 2003/0054723 | A1* | 3/2003 | Choi et al. | 445/46 |
| 2005/0112048 | A1* | 5/2005 | Tsakalakos et al. | 423/439 |
| 2006/0214550 | A1 | 9/2006 | Lee | |
| 2007/0111628 | A1* | 5/2007 | Yagi et al. | 445/24 |
| 2007/0247049 | A1* | 10/2007 | Li et al. | 313/311 |
| 2008/0003733 | A1* | 1/2008 | Kim et al. | 438/197 |
| 2008/0020499 | A1* | 1/2008 | Kim et al. | 438/20 |
| 2008/0042542 | A1* | 2/2008 | Han et al. | 313/364 |
| 2008/0261337 | A1* | 10/2008 | Tolt | 438/20 |
| 2009/0058257 | A1* | 3/2009 | Li et al. | 313/496 |
| 2009/0098790 | A1* | 4/2009 | Han et al. | 445/24 |
| 2010/0108972 | A1* | 5/2010 | Zhao et al. | 257/2 |
| 2011/0012081 | A1* | 1/2011 | Yoon et al. | 257/2 |
| 2011/0101847 | A1* | 5/2011 | Li et al. | 313/346 R |

OTHER PUBLICATIONS

E. E. Martin, J. K. Trolan, W. P. Dyke, "Stable, High Density Field Emission Cold Cathode", J. Appl. Phys., 1960, 31, pp. 782-789.

C. A. Spindt, "A Thin-Film Field Emission Cathode", J. Appl. Phys., 1968, 39, pp. 3504-3505.

P. R. Schwoebel, C. E. Holland, C. A. Spindt, J. M. Boone, "Field Emitter Arrays for Tomographic Medical Imaging" in 20th International Vacuum Nanoelectronics Conference, 2008, p. 67.

I. Brodie, P. R. Schwoebel, "Vacuum Microelectronic Devices", Proc. IEEE, 1994, 82, pp. 1006-1034.

P. R. Schwoebel, "Field emission arrays for medical x-ray imaging", Appl. Phys. Lett., 2006, 88, 113902.

A. Ghis, R. Meyer, P. Rambaud, F. Levy, T. Leroux, "Sealed Vaccum Devices: Fluorescent Microtip Displays", IEEE Trans. Electron Devices, 1991, 38, pp. 2320-2322.

F. S. Baker, A. R. Osborn, J. Williams, "The carbon-fibre field emitter", J. Phys. D, 1974, 7, pp. 2105-2115.

F. S. Baker et al, "Field emission from carbon fibers: A New Electron Source," Nature, vol. 239, pp. 96-97, 09/08. 1972.

Ramasamy Pothiraja, Nikita Bibinov, Peter Awakowicz, "Amorphous carbon film deposition on the inner surface of tubes using atmospheric pressure pulsed filamentary plasma source", J. Phys. D, 2011, 44, 355206.

M. Meyyappan, "A review of plasma enhanced chemical vapour deposition of carbon nanotubes," J. Phys. D, vol. 42, pp. 213001, (15pp) 2009.

M. Meyyappan et al, "Carbon nanotube growth by PECVD: A review," Plasma Sources Sci. Technol., vol. 12, pp. 205-216, 2003.

N. Liu, G. Fang, X. Yang, W. Zeng, C. Li, M. Wang, J. Li, X. Zhao, "Synthesis of patterned carbon nanotube arrays for field emission using a two layer Sn/Ni catalyst in an ethanol flame", Diamond Rel. Mater., 2009, 18, p. 1375-1380.

X. Calderon-Colon, H. Geng, B. Gao, L. An, G. Cao, O. Zhou, "A carbon nanotube field emission cathode with high current density and long-term stability", Nanotechnology, 2009, 20, 325707 (5 pp).

Teo KBK, Lee S, Chhowalla M, Semet V, Binh VT, Groening O, et al., "Plasma enhanced chemical vapour deposition carbon nanotubes/nanofibres—how uniform do they grow?", Nanotechnology, 2003;14, pp. 204-211.

Purcell ST, Vincent P, Journet C, Binh VT, "Hot nanotubes: stable heating of individual multiwall carbon nanotubes to 2000 K induced by the field-emission current", Phys Rev Lett., 2002; 88(10), pp. 105502-105505.

E. Braun et al, "Carbon fibers as field emitters," Vacuum, vol. 25, pp. 425-426, 1975.

S. Iijima, "Helical microtubules of graphitic carbon," Nature, vol. 354, pp. 56-8, 11/07. 1991.

W. A. de Neer et al, "A Carbon Nanotube Field-Emission Electron Source," Science, vol. 270, pp. 1179-1180, Nov. 17, 1995.

L. A. Chernozatonskii et al, "Electron field emission from nanofilament carbon films," Chemical Physics Letters, vol. 233, pp. 63-68, 2/3. 1995.

A. G. Rinzler et al, "Field emission and growth of fullerene nanotubes," in Proceedings of the 1994 MRS Fall Meeting, 1995, pp. 61-68.

W. Shao et al, "Micro-gated-field emission arrays with single carbon nanotubes grown on Mo tips," Appl. Surf. Sci., vol. 253, pp. 7559-7562, 7/15. 2007.

G. Pirio et al, "Fabrication and electrical characteristics of carbon nanotube field emission microcathodes with an integrated gate electrode," Nanotechnology, vol. 13, pp. 1-4, 2002.

L. Gangloff et al, "Self-aligned, gated arrays of individual nanotube and nanowire Emitters," Nano Letters, vol. 4, pp. 1575-1579, 09/01, 2004.

W. I. Milne et al, "Optimisation of CNTs and ZnO nanostructures for electron sources," in Nanotechnology (IEEE-NANO), 2010 10th IEEE Conference on, 2010, pp. 62-65.

C. Li et al, "Hot Electron Field Emission via Individually Transistor-Ballasted Carbon Nanotube Arrays," ACS Nano, vol. 6, pp. 3236-3242, 2012.

* cited by examiner

NANOSTRUCTURE FIELD EMISSION CATHODE STRUCTURE AND METHOD FOR MAKING

FIELD

The various embodiments described herein generally relate to nanostructure field emission devices comprising current limiters and coaxial gate electrodes and associated fabrication methods.

BACKGROUND

Field emission cathodes have been successfully used in high resolution electron optical devices, like scanning electron microscopy and transmission electron microscopy [1]. In these devices, the cathode consists of a single needle shape emitter with a sharp tip on the order of several tens of nanometers. Even though a cold clean cathode is electrically stable at emission densities up to $10^7$ A·cm$^{-2}$ [2], the tiny emission area limits the total emission current. Therefore, to achieve a relatively high total emission current, a field emitter array is used.

The Spindt cathode (i.e. a metal cone emitter array with individual hole gates) has been widely studied since it was first designed in 1968 [3]. Many prototypes of Spindt cathode-based electron devices have been demonstrated [4-7]; however, they are still not successfully commercialized. For example, a metal emitter has a lifetime of just a few seconds in a medium level vacuum which limits the practical application of the Spindt cathode.

On the other hand, due to a high melting temperature and a low surface diffusion, a carbon-based field emitter can operate more stably in a medium vacuum [8, 9]. Furthermore, it has been reported that Carbon NanoTube (CNT)/Carbon NanoFiber (CNF) emitters can provide a stable emission current in inert gas under atmospheric pressure [10]; however there are still some deficiencies such that CNT emitters grown on resistive materials do not function properly.

SUMMARY

In a broad aspect, at least one embodiment described herein provides an electrode field emitter comprising a resistive layer having a first surface; a connection pad having a first surface disposed adjacent to the first surface of the resistive layer; and a nanostructure element for emitting electrons during use, the nanostructure element being disposed adjacent to a second surface of the connection pad that is opposite the first surface of the connection pad.

In at least some embodiments, the nanostructure element comprises one of a nanotube emitter, a nanofiber emitter, and a nanowire emitter.

In at least some embodiments, the nanostructure element is made from one of carbon, ZnO, $TiO_2$, tungsten and gold.

In at least some embodiments, the nanostructure element has a diameter in the range of about 3 nanometers to about 100 nanometers and a length of about 1 micrometer to about 10 micrometers.

In at least some embodiments, the resistive layer comprises one of a pure semiconductor material, a doped semiconductor material, a metal oxide and combinations thereof.

In at least some embodiments, the resistive layer has a resistivity in the range of about $10^2$ to about $10^5$ ohm·m.

In at least some embodiments, the connection pad has a diameter in the range of about 0.5 micrometers to about 5 micrometers and a thickness in the range of about 10 nanometers to about 300 nanometers.

In at least some embodiments, the emitter further comprises a conductive layer forming a first electrode having a first surface adjacent to a second surface of the resistive layer that is opposite the first surface of the resistive layer.

In at least some embodiments, the emitter further comprises a substrate layer that is adjacent to a second surface of the conductive layer that is opposite the first surface of the conductive layer.

In at least some embodiments, the emitter further comprises a gate electrode comprising an insulator layer disposed about the nanostructure element; and a cylinder-shaped gate electrode disposed about the insulator layer.

In at least some embodiments, the nanostructure element has a tip that is approximately at a center of the gate electrode and is coplanar with an upper surface of the gate electrode.

In at least some embodiments, the insulator layer comprises one of silicon dioxide, alumina, a ceramic, a polymer and a combination of two or more of these materials.

In at least some embodiments, the connection pad, the conductive layer and the gate electrode comprise one of metal, graphene, graphite, Indium tin oxide and aluminum doped zinc oxide.

In at least some embodiments, the conductive layer has a thickness between about 30 nanometers to about 3 micrometers.

In at least some embodiments, the gate electrode layer has a thickness between about 30 nanometers to about 500 nanometers.

In another broad aspect, at least one embodiment described herein provides a field electron emission device comprising a cathode comprising a conductive layer forming a first electrode having a first surface and a second surface; a resistive layer having a first surface adjacent to the second surface of the conductive layer; an emitter array of nanostructure electrode field emitters disposed on a second surface of the resistive layer opposite the first surface of the resistive layer, each electrode field emitter comprising: a unique connection pad disposed on the second surface of the resistive layer; and a unique nanostructure element for emitting electrons during use, the nanostructure element being disposed on the connection pad; and an anode that is in electrical communication with the cathode during use.

In at least some embodiments, the device further comprises a substrate layer adjacent to the first surface of the conductive layer.

In at least some embodiments, the emitters of the device can be implemented as described above.

In at least some embodiments, each nanostructure element is disposed at or near a center of a corresponding connection pad.

In at least some embodiments, the gate electrodes have a cylindrical shape and a corresponding nanostructure element is disposed about a longitudinal axis of the cylindrical shape.

In at least some embodiments, the tips of the nanostructure elements and an upper surface of the gate electrodes are self-aligned and have similar heights due to a polishing process.

In another broad aspect, at least one embodiment described herein provides a method of forming an electrode field emitter, the method comprising: forming a resistive layer with a flat surface; forming a connection pad on the resistive layer; forming a catalyst dot on the connection pad; and growing a nanostructure element at approximately a center of the connection pad, the nanostructure element being used for emitting electrons during use.

In at least some embodiments, the method further comprises forming an insulation layer about the nanostructure element, the connection pad and the resistive layer; forming a conductive layer about the insulation layer; forming a support layer about the conductive layer; polishing an upper surface of the support layer until a flat conductive surface and a tip of the nanostructure element emerges; and removing the conductive surface to form a coaxial gate electrode.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment and the figures will now be briefly described.

Figure 1A:
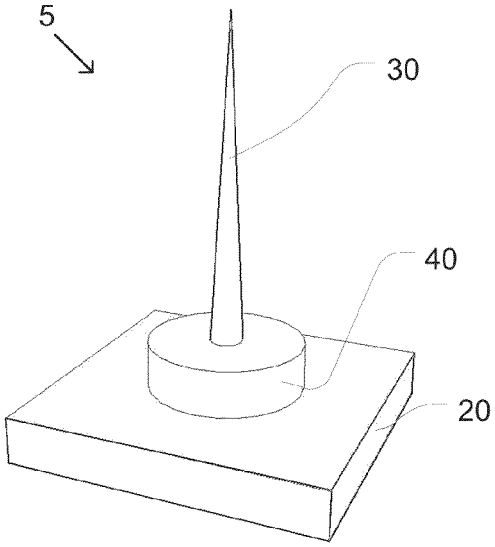
FIG. 1A is a schematic diagram of an example embodiment of a CNT emitter with a current limiter and a connection pad.

Further aspects and advantages of the embodiments described herein will appear from the following description taken together with the accompanying drawings.

DETAILED DESCRIPTION OF THE EXAMPLE EMBODIMENTS

Various apparatuses or processes will be described below to provide an example of at least one embodiment of the claimed subject matter. No embodiment described below limits any claimed subject matter and any claimed subject matter may cover processes, apparatuses, devices or systems that differ from those described below. The claimed subject matter is not limited to apparatuses, devices, systems or processes having all of the features of any one apparatus, device, system or process described below or to features common to multiple or all of the apparatuses, devices, systems or processes described below. It is possible that an apparatus, device, system or process described below is not an embodiment of any claimed subject matter. Any subject matter that is disclosed in an apparatus, device, system or process described below that is not claimed in this document may be the subject matter of another protective instrument, for example, a continuing patent application, and the applicants, inventors or owners do not intend to abandon, disclaim or dedicate to the public any such subject matter by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which the term is used. For example, the term coupling can have a mechanical or electrical connotation. For example, as used herein, the terms "coupled" or "coupling" can indicate that two elements or devices can be directly connected to one another or connected to one another through one or more intermediate elements or devices via an electrical element, electrical signal or a mechanical element such as but not limited to, a wire or cable, for example, depending on the particular context.

It should be noted that terms of degree such as "substantially", "about" and "approximately" as used herein mean a reasonable amount of deviation of the modified term such that the end result is not significantly changed. These terms of degree should be construed as including a deviation of the modified term if this deviation would not negate the meaning of the term it modifies.

Furthermore, the recitation of any numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation up to a certain amount of the number to which reference is being made if the end result is not significantly changed.

The various teachings herein provide for an improved nanostructure field emission based cathodes. The various embodiments of the nanostructure emitters shown herein generally comprise a connection pad that is coupled to a current limiter. This provides for a more robust nanostructure emitter that is well controllable and easy to fabricate as will be discussed herein. This also makes a ballast resistor feasible. In other embodiments the various embodiments of nanostructure emitters shown herein further comprise a coaxial gate structure. This also improves robustness and aids in more stable operation.

It should be noted that the term nanostructure element is meant to convey several different types of nanostructures and materials that can be used as an emitter. For example, a nanostructure element may be a nanofiber, a nanotube or molecular nanowires, for example. For example, the nanostructure element may be a Carbon NanoFiber (CNF), a Carbon NanoTube (CNT) or a Carbon NanoWire (CNW). A nanostructure element may also cover nanowires with various materials such as, but not limited to, metallic (e.g., Ni, Pt, Au), semiconductors (e.g., Si, InP, GaN, etc.), and insulating (e.g., $SiO_2$, $TiO_2$) materials. Other materials include ZnO, tungsten and gold. Molecular nanowires are composed of repeating molecular units either organic (e.g. DNA) or inorganic (e.g. $Mo_6S_{9-x}I_x$). Therefore, even though various embodiments according to the teachings herein are described with respect to CNT emitter structures, it should be understood that the teachings equally apply to CNF or other nanowire emitter structures.

Figure 1B:
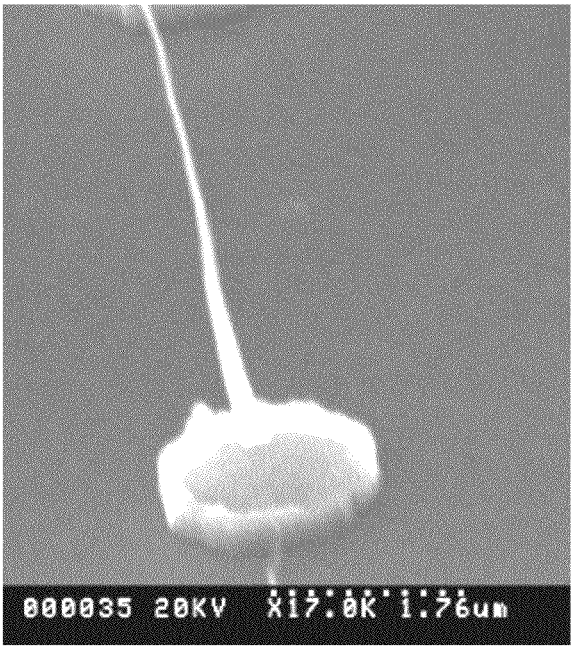
FIG. 1B is a SEM micrograph showing an example of the aligned CNT grown on a connection pad.

Referring now to FIG. 1A, shown therein is a schematic diagram of an example embodiment a CNT emitter 5. The CNT emitter 5 comprises a resistive layer 20 (also known as a current limiter), a connection pad 40 and a CNT 30. In particular, the connection pad 40 couples the CNT emitter 30 to the underlying resistive material 20. This results in a greater connection area between the CNT emitter 30 and the underlying resistive material 20 which improves robustness and stability of operation. This structure is also easy to fabricate and is well controllable meaning that the structure can be repeatedly fabricated with good accuracy thereby resulting in more reliable operation. FIG. 1B is an SEM micrograph showing an actual CNT emitter that is aligned and grown on a connection pad.

Furthermore, according to the teachings herein, it has been found that the current limiter 20 does not have to be made with a material having a positive temperature coefficient and a regular high resistivity material may be used. For example, a polysilicon or ceramic material may be used to form the current limiter 20 which results in much lower cost and simplifies the fabrication process.

In conventional CNT emitters, CNTs are generally synthesized on conductive materials such as, but not limited to, metal, silicon or Indium Tin Oxide (ITO) electrodes, for example. However, in these conventional structures there was a small connection area between the CNT and the underlying layer and so when the emission current was high, the underlying layer at the connection area had a greater chance of melting, thus leading to a CNT emitter failure. Furthermore, in conventional CNT emitters, the connection area between the CNTs and the underlying layers was not controllable during the fabrication process, and therefore it was difficult to control the resistance of the current limiter which impaired the stability of the conventional CNT during use.

Figure 2A:
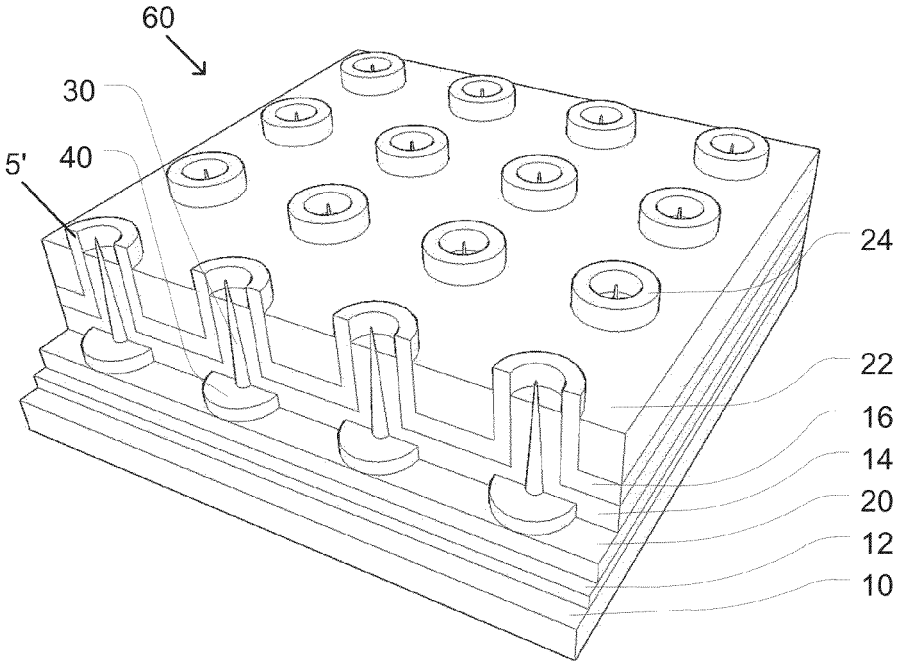
FIG. 2A is a schematic diagram of an example embodiment of a CNT emitter array in which each CNT emitter has a current limiter and a coaxial gate.

Referring now to FIG. 2A, shown therein is a schematic diagram of an example embodiment of a CNT emitter array 60 in which each CNT emitter 5' has a connection pad 40 and a coaxial gate 24, only one of which is labeled for simplicity. The CNT emitter array 60 comprises a substrate layer 10, a conductive layer 12 that acts as a bottom electrode, the current limiter (i.e. resistive layer) 20, the connection pads 40, an insulator layer 14, a gate electrode layer 16, a support layer 22 and a coaxial gate 24.

The conductive layer 12 is disposed on top of the substrate layer 10 and acts to provide a bottom electrode. The resistive layer 20 is formed on top of the bottom electrode. The connection pads 40 of the various CNT emitters are disposed on the resistive layer 20. The CNTs 30 are disposed on each of the connection pads 40. The insulator layer 14 is disposed on top of the connection pads and the CNTs so that these components are not directly contacting the gate electrode layer 16. However, the insulator layer 14 does not cover the tips of the CNTs 30. The gate electrode layer is disposed on the insulator layer 14 and shaped to form cylindrical structures around each of the CNTs 30 and coaxial gates 24 that extend past the support layer 22 which is disposed on the majority of the gate electrode layer 16.

In at least some embodiments, the conductive layer 12 may be made from materials such as, but not limited to, metal, carbon, or ITO, for example. In at least some embodiments, the conductive layer 12 has a thickness between about 30 nanometers to about 3 micrometers, for example.

In at least some embodiments, the resistive layer 20 is made of polysilicon, some high resistivity material, a pure semiconductor material, a doped semiconductor material, a metal oxide and combinations thereof, for example. The resistive layer 20 may have a resistivity in the range of about $10^2$ to about $10^5$ ohm·m, for example.

In at least some embodiments, the connection pads 40 may be made from metal such as, but not limited to, chromium or titanium, for example. In at least some embodiments, the connection pads 40 may have a diameter in the range of about 0.5 micrometers to about 5 micrometers, for example, and a thickness in the range of about 10 nanometers to about 300 nanometers, for example.

In at least some embodiments, the nanostructure element has a diameter in the range of about 3 nanometers to about 100 nanometers, for example, and a length of about 1 micrometer to about 10 micrometers, for example.

In at least some embodiments, the insulator layer 14 may be made from silicon dioxide, aluminum oxide, a ceramic, a polymer or a combination of two or more of these materials, for example.

In at least some embodiments, the gate electrode layer 16 may be made from chromium, tungsten, titanium, and the like, for example. In at least some embodiments, the gate electrode layer has a thickness between about 30 nanometers to about 500 nanometers, for example.

In at least some embodiments, the connection pads 20, the conductive layer 12 and the gate electrode layer 16 may be made from one of metal, graphene, graphite, Indium tin oxide and aluminum doped zinc oxide.

A variety of materials can be used to make the support layer such as, but not limited to, silicon dioxide, silicon nitride, aluminum, chromium, photo resist, polymer, and the like, for example.

It should be under that the particular dimensions or materials that are used for each of these elements depend on the application of the nanostructure element.

Using conventional methods, CNTs were synthesized in cavities underneath gate electrodes. The cavities were created first and then metal catalysts such as nickel, cobalt or iron were deposited as small dots in the cavities. The substrate was then heated while a process gas such as ammonia and a carbon-containing-gas such as methane were bled into the reactor. The deposition of the catalyst dots within the cavity however was not geometrically precise and therefore not always centered. Furthermore, the CNT did not usually grow in a perfectly vertically manner and therefore the CNT's tip was often not centered within the cavity. Furthermore, the CNTs did not all grow to the same height. As a result the shape and size of the conventional CNTs were not perfectly uniform, the conventional CNTs were not centered to the gate hole and they did not have the same height as the gate electrode.

According to the teachings herein, the order of the fabrication process is changed and a polishing process is used to overcome the disadvantages of conventional fabrication techniques. For example, in conventional methods, gate electrodes are formed before the nanostructure element is synthesized. In contrast, according to the teachings herein, the nanostructure element is grown first and then the gate electrode is fabricated around it.

Furthermore, the fabrication process is also self-centered and self-aligned, according to the teachings herein. For example, an insulator layer with a uniform thickness is deposited on the sidewall of the nanostructure element, and the gate electrode is deposited on the insulation layer. Therefore, the gap between the nanostructure element and the gate electrode is uniform and the nanostructure element is located at the center of the gate electrode. The polishing process results in the top surface of the coaxial gate electrodes being flat as well as the nanostructure elements and the coaxial gate electrode being level with respect to one another.

Consequently, the tips of the CNTs 30 that are fabricated using this new method are located at the center of the gate electrode holes 24 and have the same height as the top surface defining the gate electrodes 24. Furthermore, this new fabrication process has the benefit of ensuring that the CNTs 30 all have a uniform height.

Furthermore, the shape of the gate electrode 16 is cylindrical which makes the coaxial gate 24 simple to fabricate and can be made to be self-aligned during the fabrication process.

According to the teachings herein, the new fabrication process uses a deposition process to form the critical structures of the various CNT emitters described herein. A lithography process is used in the process of synthesizing CNT catalyst dots 32 (see FIG. 5B for example) and the connection pad 40, but the lithography process is not needed to fabricate the coaxial gate electrode 16.

Figure 2B:
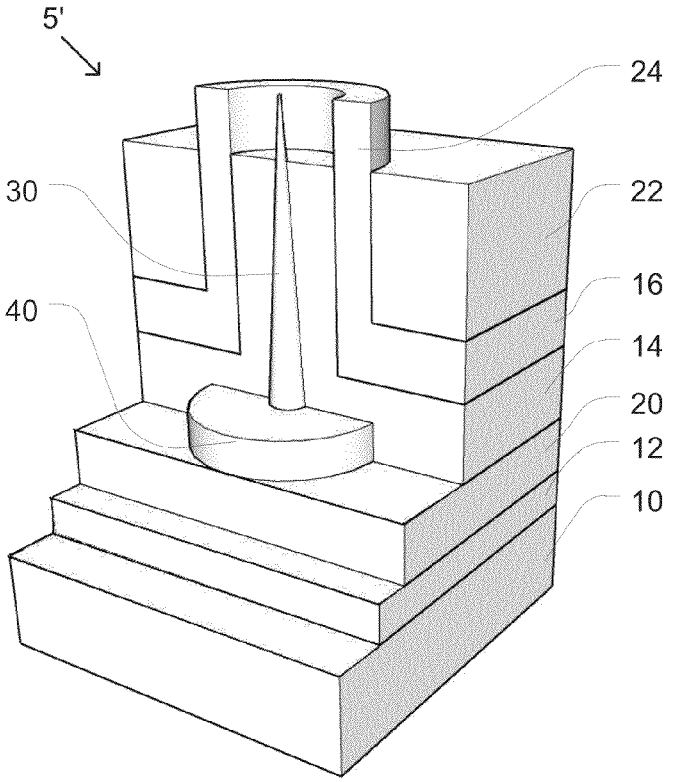
FIG. 2B is a partial cross-sectional view of a schematic diagram of an example embodiment of a CNT emitter having a current limiter and a coaxial gate.
Figure 2C:
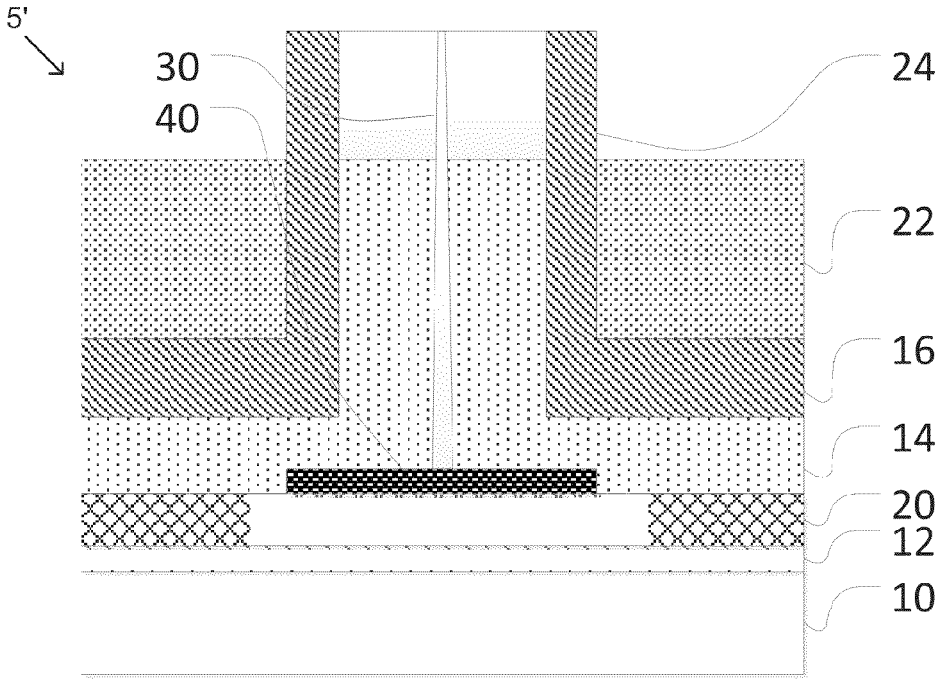
FIG. 2C is a cross-sectional view of the CNT emitter of FIG. 2B.
Figure 2D:
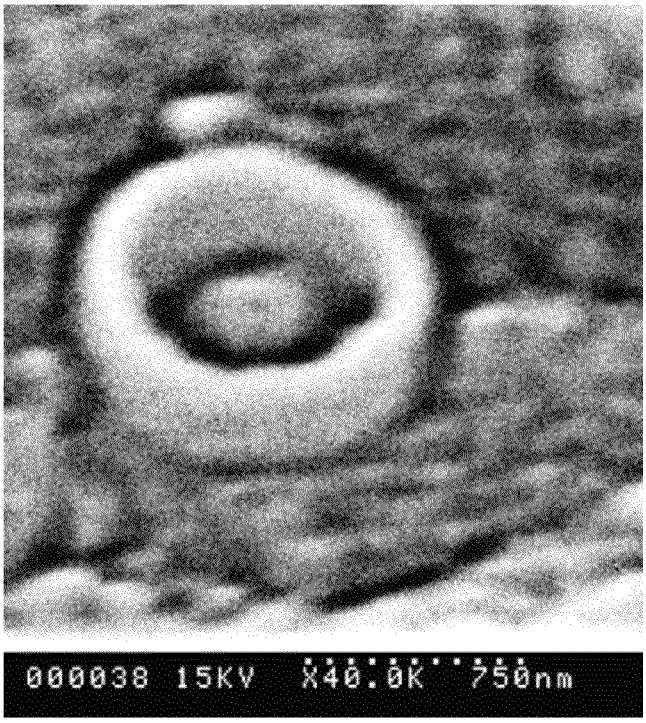
FIG. 2D is an SEM micrograph showing an example embodiment of a CNT emitter with a coaxial gate.

Referring now to FIG. 2B, shown therein is a schematic diagram of one CNT emitter 5' from the CNT emitter array 60. Each CNT emitter 5' comprises a vertically aligned CNT 30, a current limiter 20, a connection pad 40, and a coaxial gate 24. A cross-sectional view of the CNT emitter 5' is shown in FIG. 2C. FIG. 2D is an SEM micrograph showing an example embodiment of a CNT emitter with a coaxial gate.

CNT emitters such as those shown in FIGS. 2A-2D are particularly useful in electron devices such as, but not limited to X-ray tubes, traveling-wave tubes and field emission displays, for example.

Figure 3A:
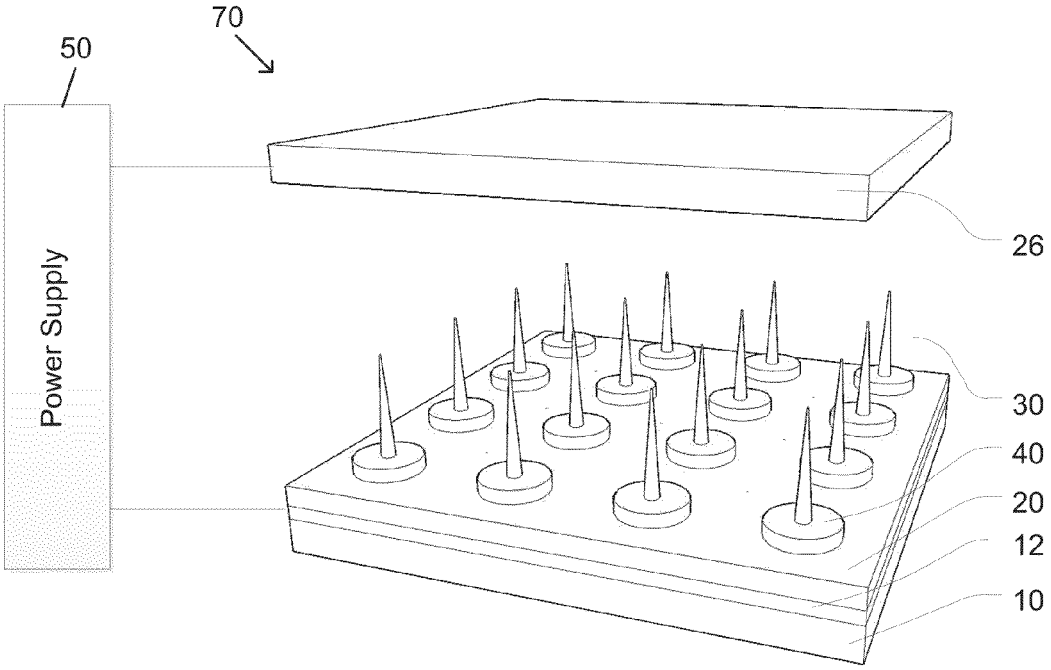
FIG. 3A is a schematic diagram of an example embodiment of an emitter array in a diode configuration.
Figure 3B:
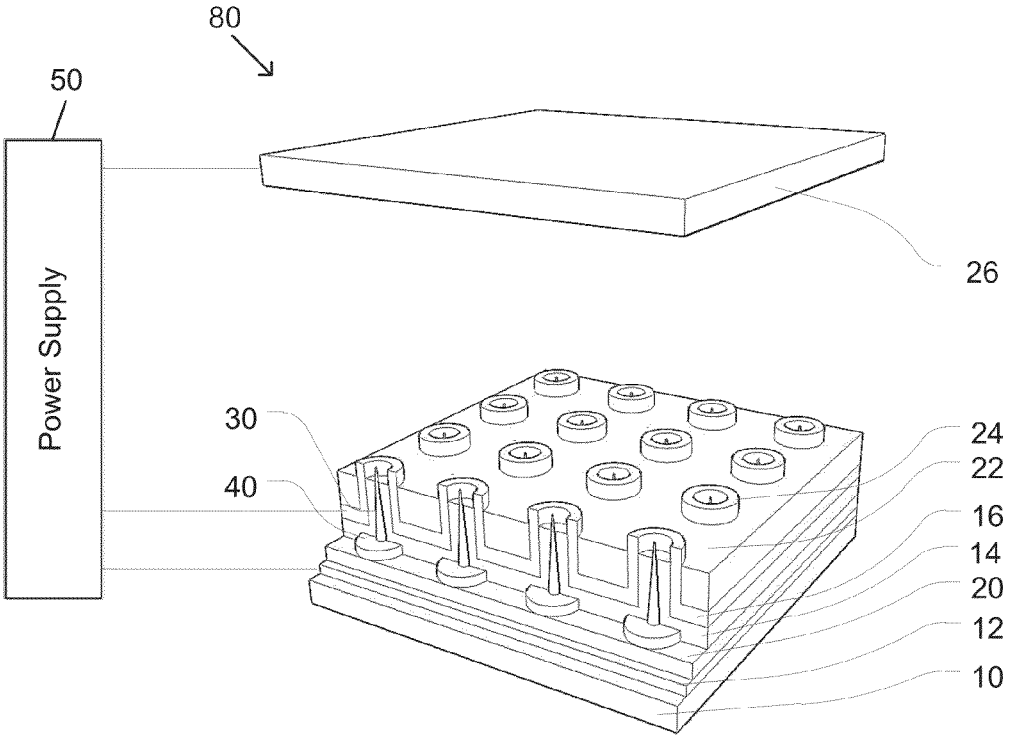
FIG. 3B is a schematic diagram of an example embodiment of an emitter array in a triode configuration.
Figure 3C:
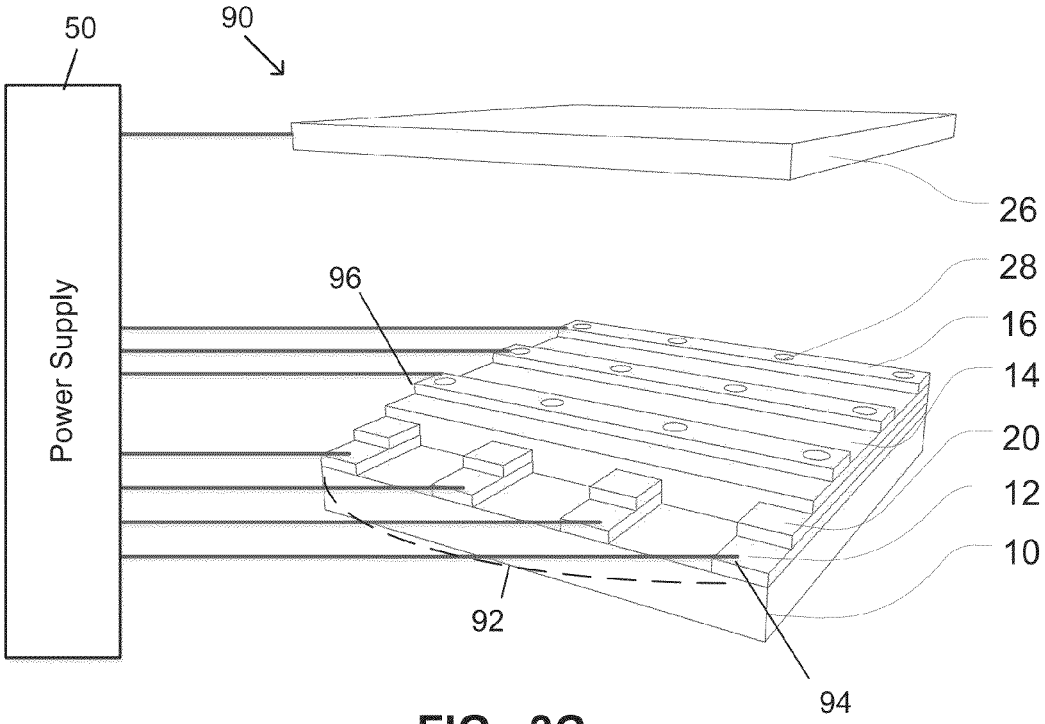
FIG. 3C is a diagrammatic view of an example embodiment of an electron device that consists of an array of CNT cathodes with each CNT cathode having an array of the CNT emitters with each CNT emitter having a connection pad and a coaxial gate as was shown in FIG. 2C.

Various devices based on the teachings herein can be developed. For example, FIGS. 3A to 3C illustrate different applications of the CNT emitters described herein. For example, the CNT emitter may be used in a diode configuration (see FIG. 3A), a triode single cathode configuration (see FIG. 3B), or a triode cathode array configuration (see FIG. 3C).

Referring now to FIG. 3A, shown therein is a schematic diagram of an example embodiment of an emitter array 70 with a diode configuration. Each of the CNT emitters 5 have connection pads 40 but they do not have a gate electrode and can be used as diodes. A power supply 50 provides a positive voltage that is applied to an anode 26, and couples the bottom electrode 12 to ground. The connection pads 40 also act as current limiters and can therefore be used to effectively prevent the CNTs 30 from being destroyed due to being exposed to too much current.

Referring now to FIG. 3B, shown therein is a schematic diagram of an example embodiment of an emitter array 80 in a triode configuration. In this case, each of the CNT emitters 5 has a connection pad 40 and a coaxial gate 24. The power supply 50 provides a constant positive voltage on the anode 26, and a constant or pulsed positive voltage on the gate electrodes 16. While the gate voltage can vary from 20 V to 200 V, the actual gate voltage that is used depends on the thickness of the insulation layer 14 and can be as low as several tens of Volts (such as 50 V) which is advantageous compared to conventional CNTs in which the gate voltage may be 1 or 2 orders of magnitude higher. The emission current can be controlled by the gate voltage. The anode voltage range from several hundred Volts to several Megavolts. The particular anode voltage that is selected depends on the application and the gap between the anode and the cathode.

Referring now to FIG. 3C, shown therein is a diagrammatic view of an electron device consisting of an array 90 of CNT emission cathodes. Each cathode 92 comprises an array of CNT emitters with each CNT emitter having a connection pad and a coaxial gate as was shown in FIGS. 2B and 2C. The array 90 of cathodes can be used to form an addressable field emission cathode array. In this case, the bottom electrodes 12 are patterned in one direction to form row electrodes 94 and the gate electrodes 16 are patterned in another direction to form column electrodes 96. In alternative embodiments, other special patterns may be used rather than just rows and columns. A scanning voltage is generated by the power supply 50 and provided to the row electrodes 94 and the column electrodes 96. By applying a low voltage on one of the row electrodes 94 and a high voltage on one of the column electrodes 96, the emission cathode at the cross of these two electrodes is activated.

Figure 4:
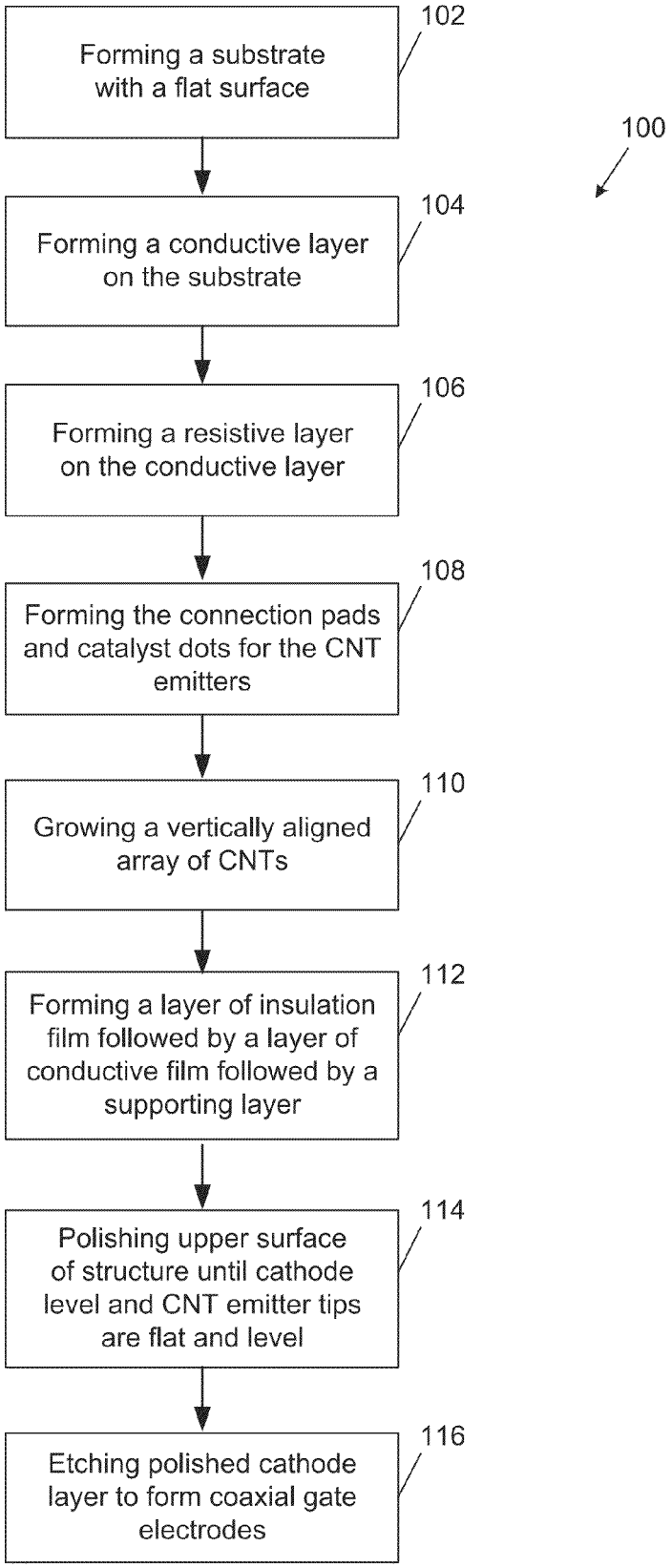
FIG. 4 is a flowchart of an example embodiment of a method for fabricating CNT emitter structures in accordance with the teachings herein.

Referring now to FIG. 4, shown therein is a flowchart of an example embodiment of a fabrication method 100 for fabricating CNT emitter structures in accordance with the teachings herein. The method 100 will be described in conjunction with FIGS. 5A to 5F which show an example of a step-by-step fabrication of a CNT emitter with a current limiter and a coaxial gate. Although only one CNT emitter structure is shown in FIGS. 5A to 5F, it should be understood that an array of CNT emitters may be formed in any desired configuration, such as those shown in FIGS. 3A-3C for example, using the fabrication method 100 or a method version thereof depending on the desired configuration. The fabrication method 100 generally corresponds to fabricating a single cathode such as that shown in FIG. 3B. However, to make other structures, such as that shown in FIG. 3C for example, the appropriate patterning techniques would be used. As another example, to make the structure shown in FIG. 3A, only acts 102, 104, 106, 108 and 110 need to be used.

Figure 5A:
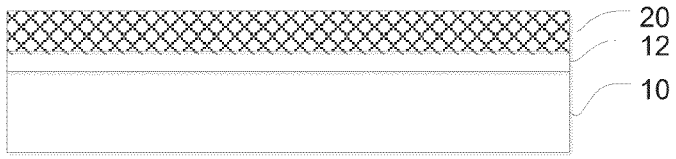
FIGS. 5A to 5F collectively illustrate an example embodiment of a fabrication process for making a CNT emitter with a current limiter and a coaxial gate.

At 102, the fabrication method 100 comprises first forming a substrate 10 with a flat surface as is shown in FIG. 5A. For a single cathode application, such as those shown in FIGS. 3A and 3B, the substrate 10 can either be made from a conductive material or an insulating material.

At 104, a conductive layer 12, such as a metal film for example, is then deposited directly on the substrate 10. The conductive layer 12 may be made from a material chosen from various materials such as metals and doped semiconductors.

At 106, in order to form a current limiter (i.e. a resistive layer), a resistive layer 20, such as a resistive film for example, is deposited over the surface of the conductive layer 12. The resistive layer 20 may be made from a material chosen from the group including pure semiconductors, doped semiconductors, and metal oxides. The resistivity of the resistive layer 20 may be between approximately $10^2$ and $10^5$ ohm*m. This resistivity makes it possible to obtain a high resistance range from several mega-ohms to several hundred mega-ohms for a resistive layer that has a thickness on the sub-micrometer scale. The resistivity of the material determines the thickness of the resistive layer 20.

However, for a field emission cathode array, as shown in FIG. 3C, the substrate 10 is made with an insulating material or an insulating layer is placed on top of a conductive material. Furthermore, to form a cathode array such as that shown in FIG. 3C, the conductive layer 12 is patterned to form a set of electrodes. In general, this patterning can be done with any patterning methods such as, but not limited, to the shadow mask, lithography, or laser cut techniques, depending on the application. This pattern process can be done before or after the CNT is grown depending on the size of the pattern. If the pattern is small it may be done after the CNT is grown, otherwise it will affect the CNT uniformity. If the pattern is big, it may be done before or after the CNT is grown.

Figure 5B:
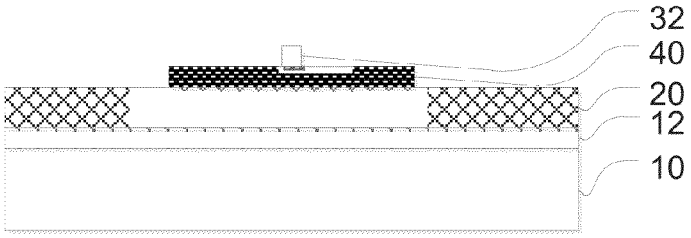

At 108, the fabrication method 100 comprises forming the connection pad 40 and catalyst dot 32 for each CNT emitter as is shown in FIG. 5B. The connection pad 40 and the CNT catalyst dot 32 may be formed by deposition and lithography. The connection pad 40 is made of metal or other high conductive materials as is known to those skilled in the art. The diameter of the connection pad 40 ranges from sub-micrometers to several micrometers. The connection pad 40 can be made to provide a resistance that is within the range of several mega-ohms to several hundred mega-ohms, depending on the application, so as to obtain good emission uniformity, good limitation of any extreme current (e.g. to protect against the over current condition) and good heat dissipation. The selection of the resistivity depends on what application the CNT emitter is used for as well as on the desired total emission current and current density.

It should be noted that an alternative embodiment to the patterning of the conductive layer and then performing 108 involves just depositing the conductive layer, and then after the catalyst dots 32 are formed, the chrome layer is then patterned and etched to form the connection pads 30. This has been found to result in better uniformity.

Currently, the catalyst dot 32 is made of iron, nickel, and cobalt, alloy of these materials or some other appropriate materials. The size of the catalyst dot 32 can be selected in a range from about several tens of nanometers to below two hundred nanometers in diameter and several nanometers to several tens of nanometers in thickness. This size of the catalyst dot 32 is related to the machine used to grow the CNT and it also changes with the fabrication condition. Optimized sizes may be different for each different fabrication facilities.

Different methods and different combinations of methods may be used to generate a certain pattern for the connection pads 40 and the catalyst dots 32 to form the desired array. These methods include various techniques such as, but not limited to, lift-off, dry-etch, and wet-etch techniques, for example.

Figure 5C:
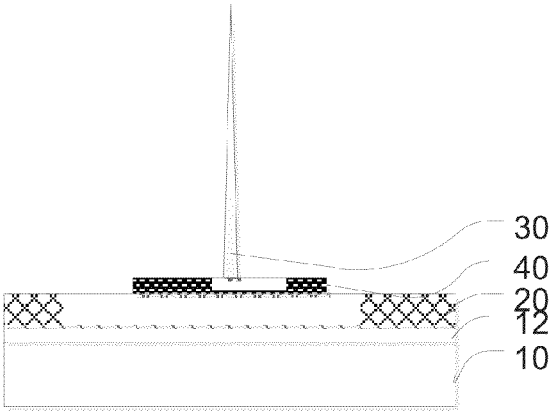

At 110, the fabrication method 100 comprises growing a vertically aligned array of CNTs 30 as is shown for one CNT in FIG. 5C. Various techniques can be used such as chemical vapour deposition [11] or Plasma Enhanced Chemical Vapor Deposition (PECVD) [12]. PECVD results in a free-form standing CNT array which is in contrast to some techniques to make conventional CNTs in which the CNTs are not spaced apart. The locations of the CNTs are determined by the location of the catalyst dots 32 with one catalyst per CNT. The CNT is grown depending on the requirements of the application such as total current and current density, for example.

Figure 5D:
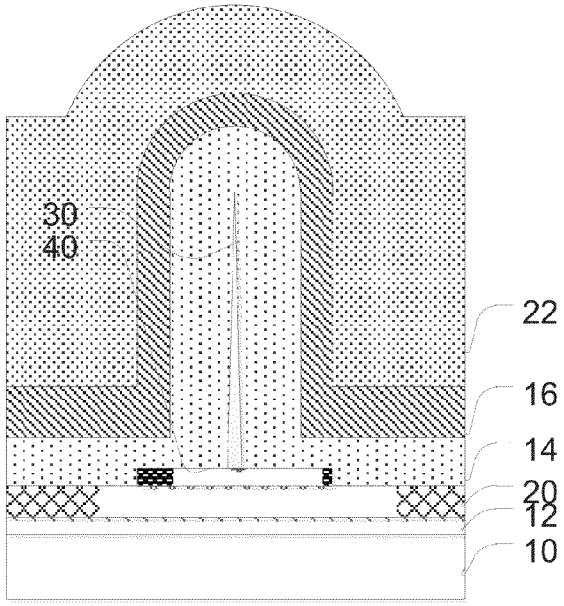

At 112, the fabrication method 100 comprises forming an insulation layer 14, such as insulation film, followed by a conductive layer 12, such as conductive film, followed by a supporting layer 22 as is shown in FIG. 5D.

The insulation layer 14 may be formed by using conformal deposition techniques such as, but not limited to, atomic layer deposition (ALD) or parylene coating, for example. However, in alternative embodiments, some other methods can also be used such as, but not limited to, plasma enhancement chemical vapor deposition, low pressure chemical vapor deposition, and the like, for example. PECVD is the easiest way to deposit the insulation layer 14, but ALD results in better quality. Parylene coating can be used in special applications for low current.

The insulation layer 14 may be made from one of silicon dioxide, alumina, ceramic, or a polymer that has a very high insulating strength, low leakage current, and can be deposited in a conformal manner. The thickness of the insulation layer 14 may be on the order of several tens of nanometers to several hundreds of nanometers or even more than a micrometer.

The conductive layer 12 may be formed by using a deposition apparatus such as, but not limited to, an evaporator or a sputtering machine, or by using a technique such as chemical vapor deposition. In cases where it is desired to form a cathode array, such as the one shown in FIG. 3C, the conductive layer 12 needs to be patterned to form electrodes.

The supporting layer 22 may be made from many different groups of materials including metals, semiconductors, semiconductor oxides, metal oxides, ceramics, and polymers, for example. The supporting layer 22 may be formed by using various techniques such as, but not limited to, physical deposition, chemical vapor deposition, spray and spin coating. The supporting layer 22 also aids in preventing the emitter from falling down during the polishing act.

Figure 5E:
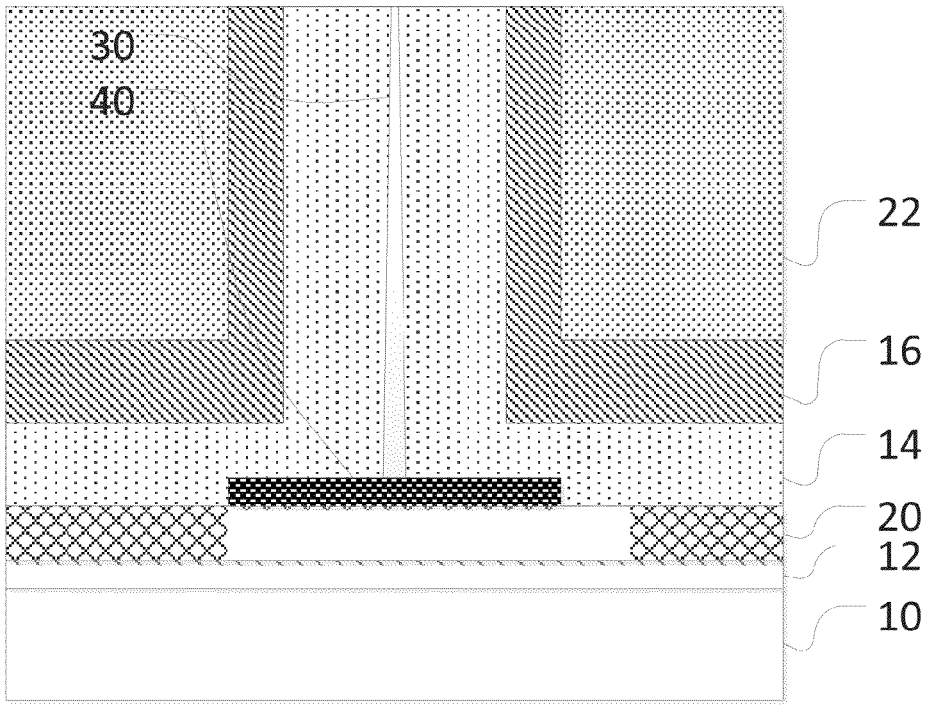

At 114, the fabrication method 100 comprises polishing the upper surface of the structure as is shown in FIG. 5E. The polishing may be performed until the top areas of the insulation layer 14, the gate electrode 16, the supporting layer 22 and an upper portion the tip of the CNTs 30 are removed until the top surface of the cathode is flat and the tips of the CNTs 30 are exposed (i.e. reach the top surface of the cathode layer) and have flat ends. Since the polishing is done after the gate electrodes 24 are formed, the height of the CNT tips and the corresponding gate electrodes are the same which increases emitter tip uniformity and performance. Advantageously, the polishing act does not appreciably change the size and shape of the emitter tip. Furthermore, there may be a catalyst dot and/or amorphous carbon at the emitter tip for PECVD-grown CNTs, but the polishing act can remove the catalyst dot and amorphous carbon from the emitter tip. In addition, since the polishing process may have up to several micrometers of material to remove, a high surface flatness can be achieved.

Figure 5F:
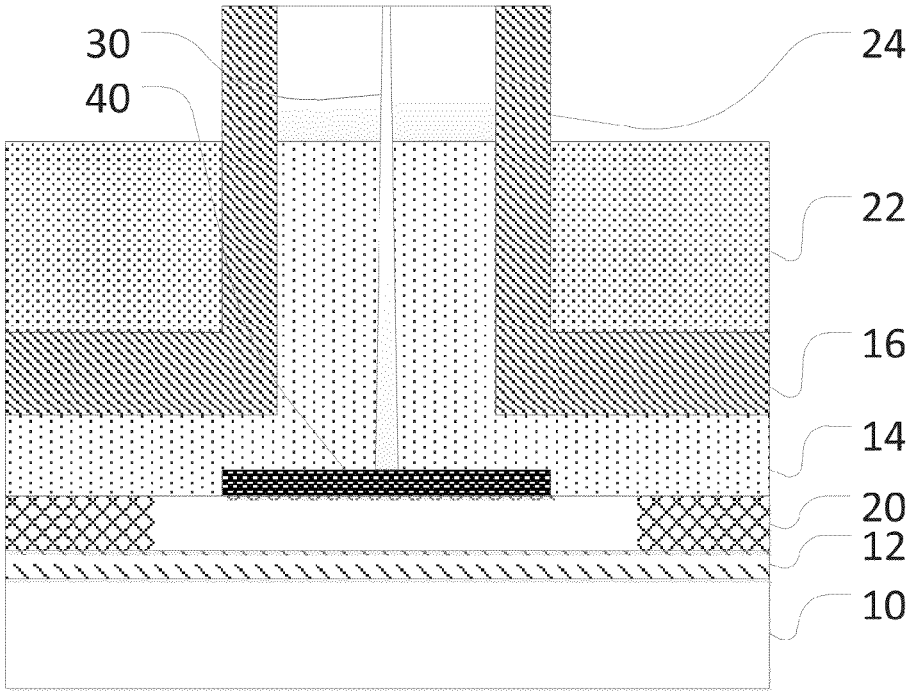

At 116, the fabrication method 100 comprises etching portions of the support layer 22 and the insulator layer 14 in the vicinity of the CNTs 30 to remove the insulation material between the tips of the CNTs 30 and the conductive layer 16 to form a coaxial gate electrode 24 as is shown in FIG. 5F. The depth of the cavity between the CNT 30 and the coaxial gate electrode 24 ranges from several tens of nanometers to over a micrometer depending on the particular application. The supporting material 22 around the coaxial gate 24 may or may not be removed, depending on the chosen supporting material. Parameters for the etching process are determined by the materials used for the insulator layer 14 and the gate electrode layer 16 as well as the need to portions of the insulation layer 14 but not etch the CNT 30 or the coaxial gate electrode 24.

Comparison of Various Emitters

Traditional x-ray tubes rely on thermionic cathodes to generate electrons and are well suited for most applications. However, because thermionic cathodes work at high temperatures they have high power consumption and slow response times. As a result, thermionic cathodes are not suitable for some modern applications such as pulsed X-ray tubes (which can be used to build CT scanners without moving parts) or flat panel X-ray sources (which can be used in radiation sterilization and food irradiation).

Field emission cathodes ("cold-cathodes") are an excellent alternative to traditional thermionic cathodes because they overcome the disadvantages of thermionic cathodes. There are two kinds of field emitters which have seen some success and are currently being commercialized: the Spindt cathode and the carbon nanotube (CNT) film emitter. One drawback of the Spindt cathode is that it requires an ultra-high vacuum to work. Unlike the Spindt cathode, the CNT film emitter does not require an ultra-high vacuum for operation but it has several other disadvantages including: 1) the CNT emitter density and uniformity is not controllable, 2) the required gate voltage is over 1,000 V, and 3) the CNTs are tangled together and so a current limiter cannot be utilized.

Table 1 provides a comparison for typical cases (some exceptions have not been considered) between conventional emitters (Thermionic, Spindt, CNT film) and a nanostructure emitter which is an emitter fabricated in accordance with the teachings herein. As can be seen the nanostructure emitter has several desirable features including not requiring operation in an ultrahigh vacuum, high frequency operation, high emission current density, high emitter density, low gate control voltage, high emission stability, fail-safe protection, low working temperature and high mechanical strength as well as several other desirable features.

Nanostructure emitters, fabricated in accordance with the teachings herein, can be used in CT scanners to obviate the need for a rotating gantry (since in conventional CT scanners only one X-ray source is used so it needs to rotate). Instead, with a nanostructure-based cathode emitter, as is taught herein, X-rays can be emitted from a ring of sources whose individual nanostructure field emitter based cathodes are switched on/off by a controller to aim, pulse, and shape radiation and modulate it's intensity to create desired image characteristics or to conform to a radiation treatment plan. The nanostructure field emitter based cathode's design, quality control, and performance make it an important component for reliable and cost-effective stationary CT scanners.

TABLE 1 comparison of electron emitters

| Property | Thermionic | Spindt | CNT film | CNT with Coaxial Gate and Ballast Resistor |
|---|---|---|---|---|
| Does not need an ultrahigh vacuum to work ($10^8$ Torr) | Yes $10^7$ | No $10^{12}$ | Yes $10^8$ | Yes $10^8$ |
| High working frequency (e.g. over 1 GHz) | No (<Hz scale) | Yes | Yes | Yes |
| High emission current density (e.g. 300 mA/cm$^2$ constant emission current) | Yes | Yes | No | Yes |
| High gate electrode trans. efficiency (>99%) | N/A | Yes | No (<80%) | Yes |
| High emission current uniformity over a big area | No | Yes | No | Yes |
| Maximum substrate size 12 inch silicon wafer | N/A | Yes | Yes | Yes |
| High emitter density ($10^7$ emitter/cm$^2$) | N/A | Up to $10^9$ | Not controllable | $10^7$ |
| Low gate control voltage (<50 V) | N/A | >100 V | >1000 V | <50 V |
| Good stability when emission current is high | Yes | Only In UHV | <1% duty cycle | Yes |
| Emitters have current limiter | No | Yes | No | Yes |
| Fail-safe protection | do not need | Yes | No | Yes |
| Micro-scale emission cell size (diameter of emitter cell) | No | ~1 μm | N/A | <3 μm |
| Low working temperature | No | Yes | Yes | Yes |
| Low profile (<1 μm) | No | Yes | No | Yes |
| Shock resistant | No | Yes | No | Yes |
| Customizable emitter size (diameter from <100 μm to 30 cm) | No | Yes | Yes | Yes |
| Customizable emission area shape | No | Yes | Yes | Yes |
| Fabricated with regular semiconductor facilities | Machining | Needs special sputter machine | Does not need special device | Needs dc-PECVD machine |

Example 1

A fabrication process was optimized to give full play to the nature of the micro-fabrication process, namely, the uniformity and thickness of a deposited film such that it can be well controlled. Electron beam lithography was used to pattern connection pads and the CNT catalysts. The coaxial structure was self-centered and the height of the CNT and the gate was self-aligned. A test sample was made having the configuration shown in FIG. 3B.

First, a layer of 200 nm chrome and 500 nm poly-silicon was deposited on a highly doped silicon wafer. Second, a layer of 200 nm chrome was deposited and patterned to form a connection pad. Third, a CNT catalyst was patterned and deposited at the center of the connection pad, and then CNTs were grown using PECVD. As an alternative, to get better uniformity, the second step may just depositing chrome and after the third step, the CNT catalyst is formed, and the chrome layer is then patterned and etched to form the connection pad. In this structure, the bottom chrome layer has two functions: 1) to increase lateral conductivity to avoid non-uniformity; and 2) to prevent the doping materials in the wafer from diffusing into the p-Si layer. The top chrome layer has four functions: 1) to provide a uniform size connection pad for the resistor array in order to achieve a uniform emitter resistance; 2) to avoid diffusion of nickel catalyst into polysilicon; 3) to improve adhesion between CNTs and polysilicon (p-Si); and 4) to increase heat dispersion.

Next, a 300 nm silicon dioxide insulation layer was coated in a conformal manner on the CNT array by PECVD. Then, a layer of 200 nm chrome was deposited by electron-beam evaporation to form the gate electrode. Next, a 2 μm silicon dioxide layer was deposited by PECVD. This silicon dioxide layer was used as a supporting structure to prevent the CNTs from breaking or falling down in the polishing step. The samples were then polished to get a flat top surface and to ensure that the CNT tips and coaxial gates were level. The silicon dioxide between the CNT tips and the coaxial gates was removed using a plasma dry etch for about 500 nm. After the entire fabrication process, the height of an exposed CNT tip was about 500 nm, the diameter of the cylinder shaped coaxial gate was about 800 nm, and the emitter-gate gap was about 250 nm.

The sample was tested in a vacuum chamber with a base pressure of $3\times10^{-8}$ Torr. A 6 μm thick silver foil anode was mounted a few millimeters apart from the sample and a 1,000 V voltage was applied. A sweep voltage (Vg) was applied on the coaxial gate electrode to generate an emission current. The CNT emitter was grounded through a picoammeter to measure the emission current.

Figure 6A:
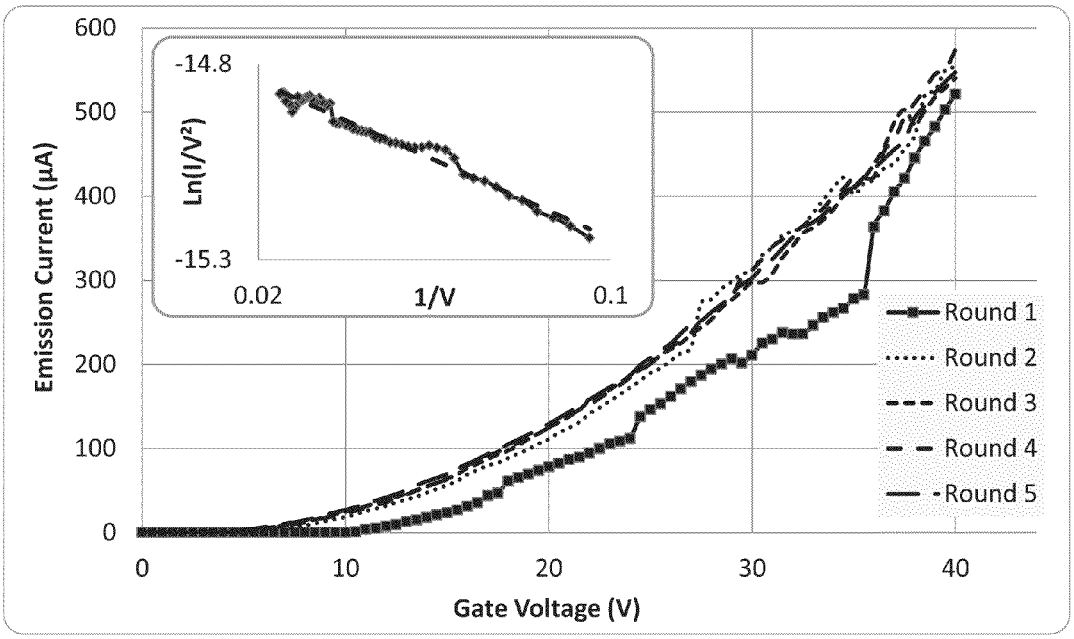
FIG. 6A is a graph illustrating emission current versus gate voltage for a CNT emitter test sample.

The current versus the gate voltage curve is shown in FIG. 6A. In the first test round, the emission current achieves 521 μA at Vg=40 V. In the following test rounds, the emission currents ranged from 540 μA to 570 μA at Vg=40 V, which are all higher than the emission current of the first test round. This current increase may be caused by the annealing process during the first test round and the removal of residual gas molecules from the emitters. In the following test rounds, the emission current had a good repeatability which indicates that the emitter array had a good stability under this working condition. The Fowler-Nordheim plot of the average emission current is shown in the inset of FIG. 6A. Due to the existence of the ballast resistor, the emission current led to a voltage increase at the emitter tip. As a result, the effective voltage between the emitter tip and the gate electrode decreased. From the fabrication parameters, the resistance of the ballast resistor under each CNT emitter was about 50 MΩ. The emitter array had 2,121 emitters and the total emission current was about 550 μA. The average current was about 0.26 μA per CNT.

Figure 6B:
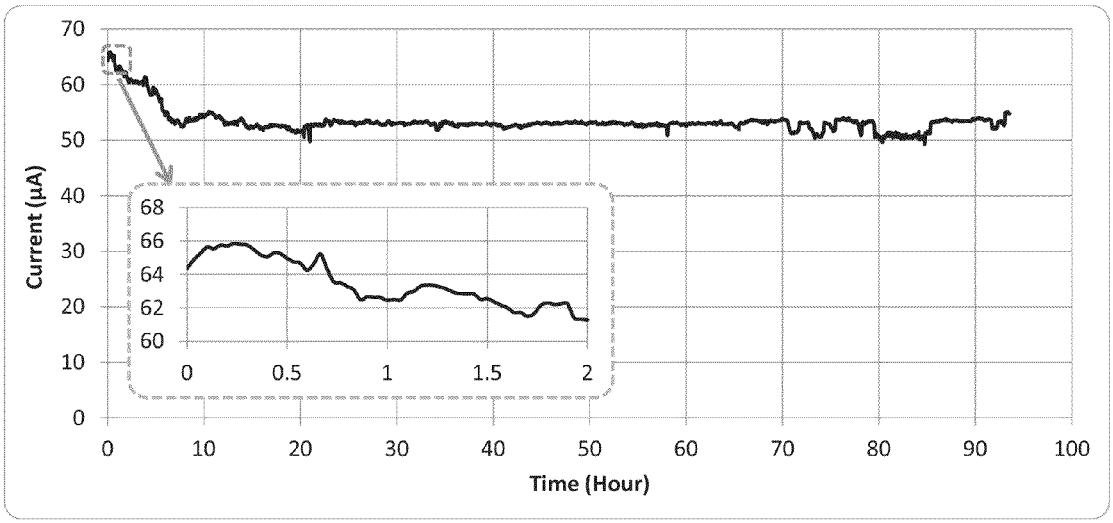
FIG. 6B is a graph illustrating current versus time for a showing long-term stability test of a CNT emitter test sample.

FIG. 6B shows a current versus time curve for a long term stability experiment. The sample CNT emitter was not annealed before the experiment. The inset of FIG. 6B shows the emission current during the first two hours. In the first 10 min, the emission current had a slight increase. After the first ten minutes, the current decreased from 66 μA to 52 μA and became stable after 10 h. The fluctuation of the emission current between 30 h to 50 h was about 3.2% (the current's amplitude ranged from 51.7 μA to 53.4 μA). In previous experiments, conventional CNT emitters were shown to have 5% emission current fluctuation under a constant voltage mode [13], or about 13% voltage increase under a constant current mode in which the emission current degraded so much with time that in order to keep the current constant, the voltage had to be increased [14]. When compared to these results, the sample CNT emitter made according to the teachings herein has a lower fluctuation and better long term stability.

The test sample CNT emitter of this section had three beneficial attributes: 1) the fabrication process was self-aligned and self-centered and so the misalignment and non-uniformity of the conventional gate CNT emitters were overcome, 2) the emitter-gate gap was just a few hundred nanometers and no the gate voltage decreased to several tens of volts, and 3) the ballast resistor improved the emission current uniformity and stability and as a result the emission current density and long term stability was increased.

Example 2

A test sample was fabricated on a silicon wafer. The test sample had the configuration shown in FIG. 3A. The fabrication process consisted of four steps. The substrate was an n-doped silicon wafer. First, 200 nm chrome, 500 nm polysilicon (p-Si), and 200 nm chrome thin films were deposited onto the wafer by electron-beam evaporation. Second, a thin layer of nickel was deposited and patterned to form the catalyst dot array by electron-beam lithography, electron-beam evaporation, and a lift-off process. Third, the top chrome layer was patterned and etched to form an array of connection pads by electron beam lithography and wet etched with chromium etchant. Finally, vertically aligned multiwall CNTs were grown on the sample by dc-PECVD. The electric field caused the CNTs to align vertically during growth, and the shape of the CNTs could be varied from straight whisker-like to conical tip-like by changing the ratio of the gases [15]. The conical tip-like shape was desired during fabrication and catalyst dots were at the tips of the CNTs suggesting the tip-growth diffusion mechanism. The CNT array contained several tens of layers of well crystallized graphene walls which were parallel to the axis of the CNTs [15]. The CNTs were about 5 μm in height, and 10 μm apart from each other. There was a total of 2,121 CNTs in a 0.2 $mm^2$ emission area. The resistivity of the p-Si layer was 640 Ω·m, the thickness was about 500 nm, and the size of the top chrome connection pad was about 2 μm in diameter. Thus, the resistance applied on an individual CNT was about 80 MΩ, which can effectively overcome the emission current non-uniformity caused by both geometry and position.

The sample was tested in a vacuum chamber with a base pressure of $5e^{-8}$ Torr. A silicon wafer was used as an anode and a 50 μm thick Teflon® film was sandwiched between the cathode and the anode. The gap between the emitter tips to the anode was about 45 μm which is equal to the film thickness minus the CNT height. A picoammeter was used to measure the emission current. A DC voltage was applied in either a scanning mode (e.g. stepped voltage) or a constant mode. In the scanning mode, the voltage (range was from 400 to 800 V) was increased by a specific value every 5 s and the current at each voltage was measured to obtain the I/V curve. The constant mode was used for both annealing purposes and characterizing the emission stability. The experiments were preformed after a 60 h initial annealing process at 400 V to remove residue gas molecules from the emitter surface.

Figure 7A:
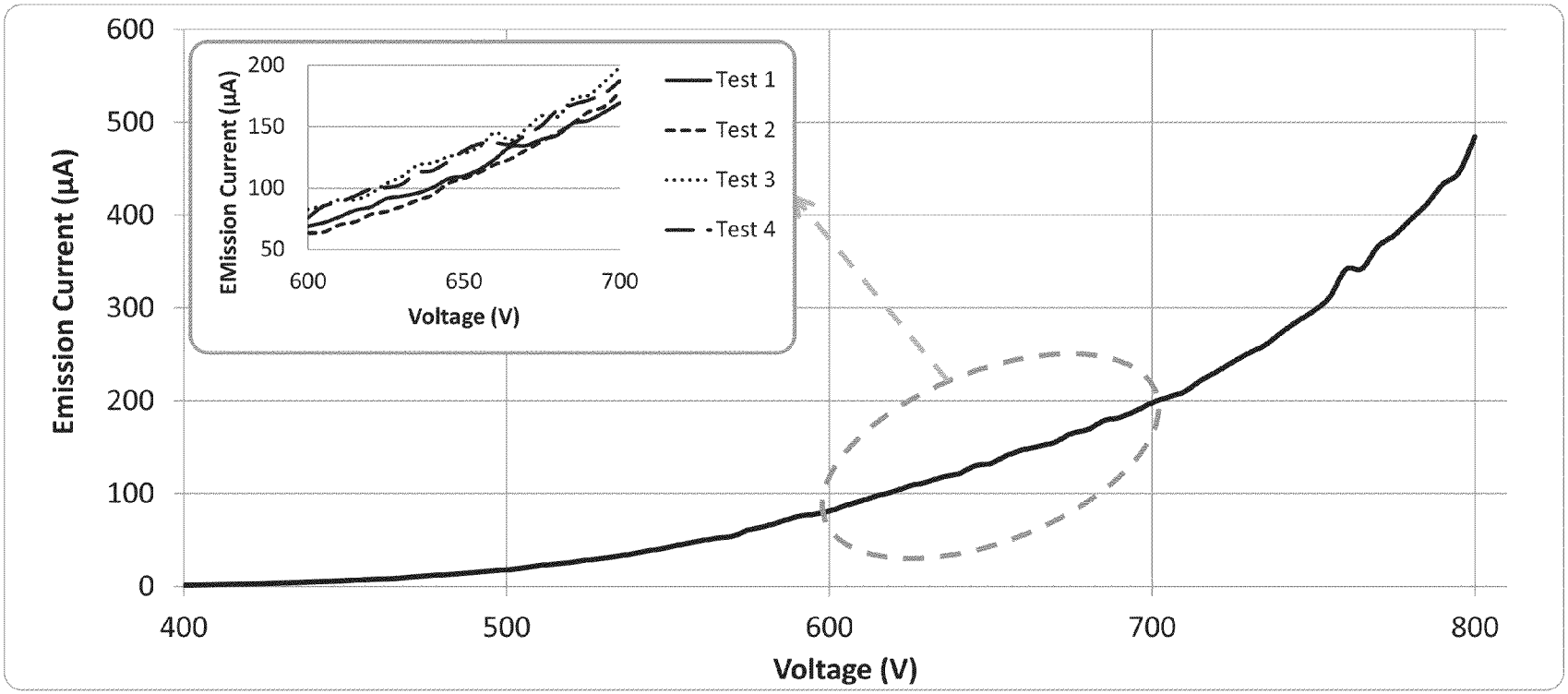
FIG. 7A is a graph illustrating emission current versus voltage of a CNT emitter test sample.

Several observations can be made from the test results. The first observation is the emission current has a good repeatability. The current versus voltage plots of the average emission current is shown in FIG. 7A. The inset of FIG. 7A shows the current versus voltage for each test round of the experiment.

Figure 7B:
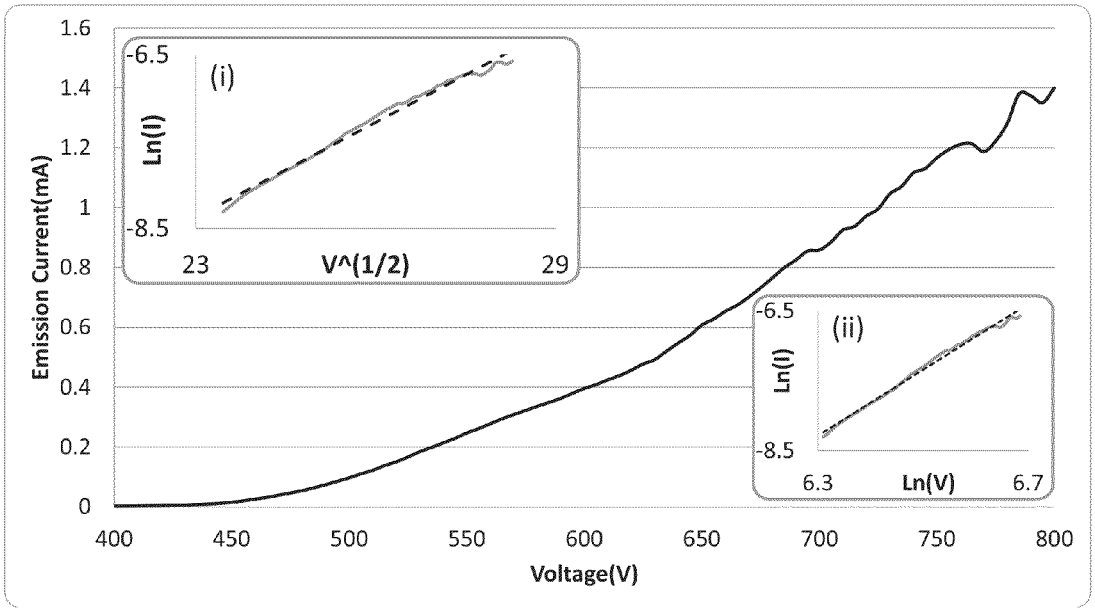
FIG. 7B is a graph showing current versus voltage for a CNT emitter test sample which is heated up to a temperature about 1,700 K with a first inset showing a Schottky plot of a high field region and a second inset showing a space-charge limit current plot of the high field region.
Figure 7C:
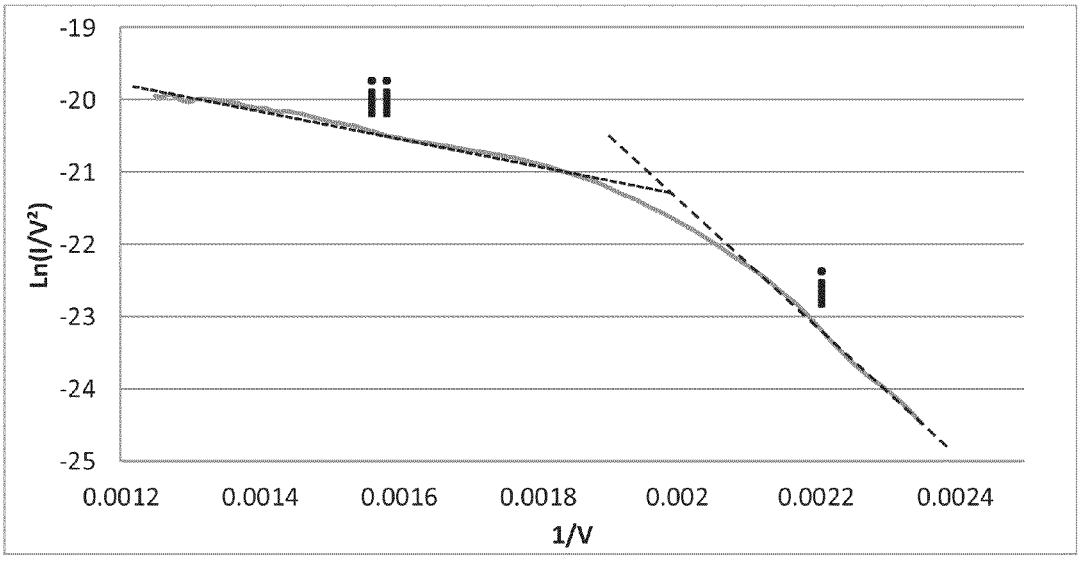
FIG. 7C is an F-N plot corresponding to the data shown in FIG. 7B.

A second observation was that the emission current is affected by the emitter temperature. The emission current of 800 V at room temperature was about 500 μA. However, when the emitter was heated up to a temperature over 1,700 K, the emission current increased to about 1.4 mA. The current versus voltage plots of the average emission current at high temperature is shown in FIG. 7B. The insets (i) and (ii) of FIG. 7B show the high field regions of a Schottky plot and a space charge limited current plot, respectively. The Schottky plot presents the logarithm graph of the current versus the square root of the voltage. The space-charge limited current plot shows the curve of the logarithm of the current versus the logarithm of the voltage. These two plots are close to a straight line which indicates that the emission in the high field region is a Schottky emission. The F-N plot of the average current is shown in FIG. 7C. The F-N plot consists of two segments. The low voltage (segment i) has the steepest slope. At a higher voltage and current (segment ii), the slope of the curve is decreased as the emission current is limited by the ballast resistor.

A third observation was that the CNT structure can withstand high temperatures and high currents. The emission current achieved 1.87 mA at a high temperature of 1,700 K. Since there were 2,121 CNTs in the cathode; therefore, the average emission current was about 0.9 μA/CNT. This value is close to the maximum suggested emission current of an individual CNT. This result indicated that the ballasted CNT array can withstand a high emission current, and the F-N plot shows the ballast resistor worked properly and effectively protected the CNT from over current.

Example 3

The test sample was fabricated on a silicon wafer. First, a layer of 100-nm chrome was deposited on the substrate. Then, a layer of 500-nm polysilicon was deposited by an electron beam (e-beam) evaporator. The resistance can be approximated by $R=\rho*L/A$, where ρ is the resistivity of polysilicon (640 Ω·m), L is the thickness of the resistance layer, and A is the area of the connection pad. However, the bottom electrode had a larger size than the connection pad, which makes the calculation not accurate. Furthermore, due to the small size of the top electrode, a direct measurement of the resistance was not easily achieved. As a result, the actual resistance was not easily controlled during the fabrication process and could only be determined by experimentation.

Deposition and patterning of the connection pad and the CNT catalyst dots was done by depositing a connection layer without patterning, depositing the catalyst dots by lift-off, and then patterning the connection pad by wet etching. Since the connection layer was deposited without patterning, the e-beam resist layer was perfectly flat, and the catalyst dots achieved their best uniformity. After the catalyst dots were lifted off, a layer of e-beam resist on the connection layer was patterned. Next, the wafer was immersed in a chrome etchant, and the connection pad was obtained. The CNTs were then grown on the sample by dc PECVD. The electrical field in the PECVD machine determined the orientation of the CNTs, and the size of the catalyst dots determined the bottom diameter and the height of the CNTs. The test sample consisted of 2,121 CNTs in a 0.2 $mm^2$ area with the CNTs being about 5 μm in height and 10 μm apart.

Figure 8A:
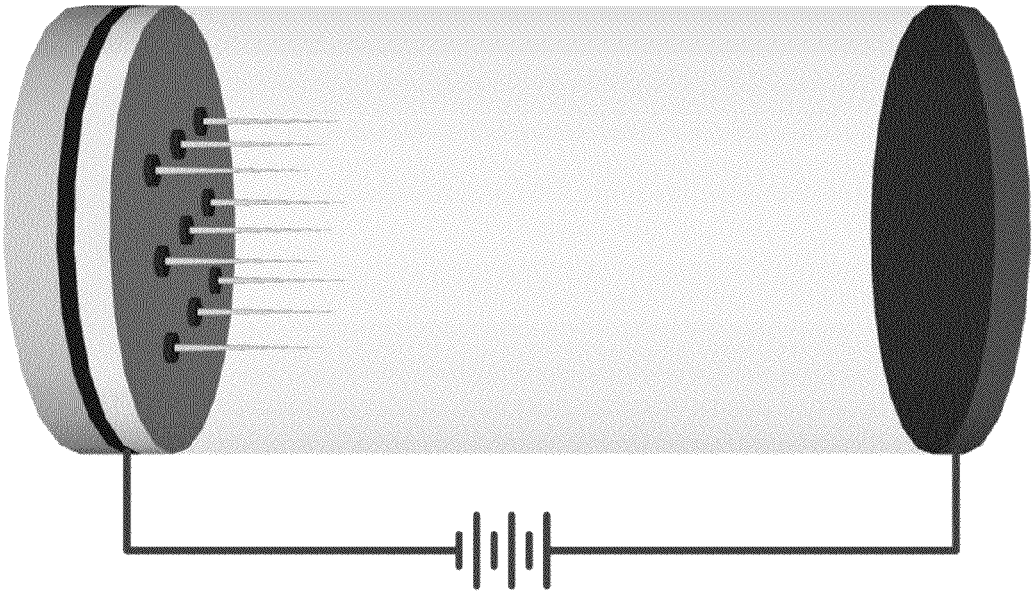
FIG. 8A is a schematic of an example embodiment of an X-ray tube that incorporates CNT emitters in accordance with the teachings herein.

The test sample was tested in an X-ray tube prototype with a simple diode configuration that included a transmission target. FIG. 8A shows a diagram of the X-ray tube test setup. The target was a 6-μm-thick silver foil that was placed about 7 mm from the cathode. A constant high voltage was applied to the target and the cathode was grounded. A radiation dose rate meter was mounted outside the X-ray window so that the maximum achievable radiation dose rate was measured.

First, a 17.5-kV constant voltage was applied and an average 20-μA emission current was obtained. The corresponding radiation dose was between 13 and 17 mR/h. Due to target outgassing, when a high voltage was applied, the pressure in the vacuum chamber increased to about $8\times10^{-8}$ torr. Afterwards, the vacuum pressure decreased back down to $5\times10^{-8}$ torr in 1 h. Target voltages of 20, 22.5, 25, and 27.5 kV were subsequently applied. The corresponding currents and doses were 25 μA/50-55 mR/h, 35 μA/120-130 mR/h, 50 μA/160-170 mR/h, and 65 μA/180-185 mR/h, respectively. In further experiments, when voltages of 22.5-kV, 25-kV, and 27.5-kV were applied, the vacuum pressure increased over the threshold pressure which triggered the vacuum protection to cut off the high voltage. In this process, the e-beam heated up the anode and released the gas molecules adsorbed on the anode. With the removal of the adsorbed gas molecules, the X-ray tube power increased and achieved 1.8 W. At 30 kV, the current was about 90 μA, and the tube power was 2.7 W. At this power, the outgassing rate from the anode was too high to be pumped down, the experiment was stopped and no visible damage to the sample was observed when it was inspected under an optical microscope.

Figure 8B:
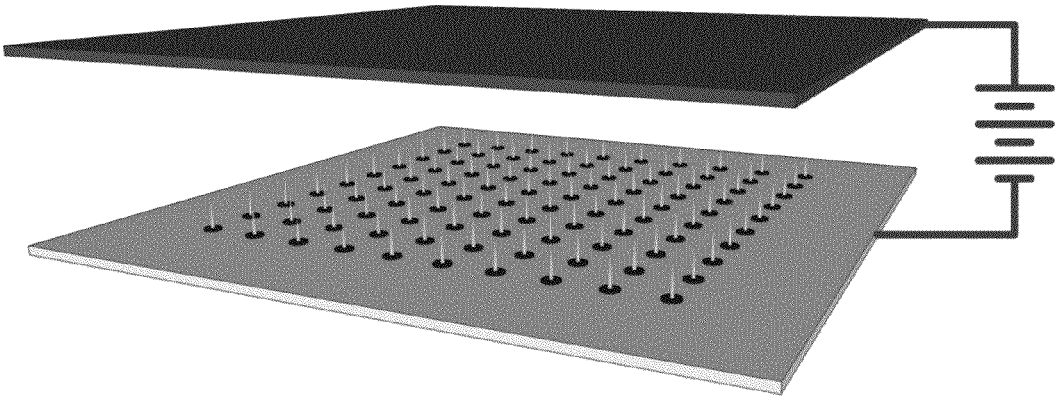
FIG. 8B is a schematic of an example embodiment of a flat panel X-ray tube that incorporates CNT emitters in accordance with the teachings herein.

Referring now to FIG. 8B, shown therein is a schematic of an example embodiment of a flat panel X-ray tube that incorporates CNT emitters in accordance with the teachings herein. Using the CNT emitter structures and techniques described herein allows for the possibility of fabricating a device that can be as large as 12" or larger since the emitter cathode can be made in a large size. This is not possible with a conventional thermionic cathode based X-ray tube. A flat panel X-ray tube as shown in FIG. 8B may be used in radiation sterilization and food irradiation where high power large area X-ray irradiation is needed. The configuration of FIG. 8B may also be used as a flat panel light source such as the back light of an LCD display.

For the various example embodiments described herein that incorporate a coaxial gate electrode, the cathodes made using these structures can work in either a diode structure or a triode structure. Such field emission cathodes show desirable emission properties such as high current density, low control voltage and excellent uniformity, for example.

In the various examples provided herein, a vertically aligned CNT is used as the emitter. However, as explained previously, other nano-scale structures may be used as the emitter to form the emission cathode according to the teachings herein. Examples of such nanostructure elements include, but are not limited to, a carbon nanotube, a carbon nanowire, and a carbon nanofiber, for example. Some other examples of nanowires include ZnO nanowire, TiO nanowire, tungsten nanowire, gold nanowire, etc. Other conductive coating materials may be used as well such as, but not limited to, metallic (e.g., Ni, Pt, Au), semiconductors (e.g., Si, InP, GaN, etc.), and insulating (e.g., $SiO_2$, $TiO_2$) materials. Molecular nanowires may also be used composed of repeating molecular units either organic (e.g. DNA) or inorganic (e.g. $Mo_6S_{9-x}I_x$). All of these structures may be referred to as nanostructure elements.

In the teachings provided herein, various example embodiments have been described for self-protected, vertically aligned nanostructure field emission cathodes with self-aligned and self-centered coaxial gate electrodes that can be used in vacuum micro/nano electronic devices. The cathodes may be formed by a cellular array of emission sites that each have a vertically aligned nanostructure element, a resistive layer, an electrically conductive bottom electrode, a connection pad and a cylinder shape coaxial gate electrode. The resistive layer and the connection pad limit the current of each site to a safe value and also stabilize such currents. The resistance applied on each emission site is well controlled due to the use of the connection pad.

In the teachings herein, various example embodiments have been described for fabricating the nanostructure emitters described herein. For instance, one example embodiment of such a method comprises depositing and patterning a resistive layer, a connection pad layer, and a CNT catalyst layer; growing CNTs; depositing an insulator layer, a gate electrode layer and a supporting layer; polishing the top surface to expose the CNT tips and make them level with an upper surface of the coaxial gate electrodes; and removing or etching the insulator material between the CNTs and the corresponding gate electrodes. The method of forming the coaxial gate is self-aligned and self-centered based on using electric fields to control the alignment. In some embodiments, the coaxial gate is not formed.

It should be noted that there can be alternative embodiments where the various structures described herein are formed without a substrate layer. This may occur in cases where the conductive layer 12 is strong enough to support the emitter structure.

In addition, there can be alternative embodiments in which only one of the substrate layer and the conductive layer is used if both of these layers can be made with a high enough conductivity. For instance, there may be some cases in which a metal substrate is used and there is no need for an extra conductive layer since the metal substrate provides the same functionality as the conductive layer would.

In these alternative embodiments, the resulting emitters or devices can be described as having a conductive layer rather than both a conductive layer and a substrate layer.

While the applicant's teachings described herein are in conjunction with various example embodiments provided for illustrative purposes, it is not intended that the applicant's teachings be limited to such embodiments. On the contrary, the applicant's teachings described and illustrated herein encompass various alternatives, modifications, and equivalents, without departing from the embodiments described herein.

REFERENCES

[1] P. R. Schwoebel, C. A. Spindt, C. E. Holland, J. A. Panitz, in 13*th International Vacuum Microelectronics Conference,* 2000, pp. 980-987.

[2] E. E. Martin, J. K. Trolan, W. P. Dyke, *J. Appl. Phys.,* 1960, 31, pp. 782-789.

[3] C. A. Spindt, *J. Appl. Phys.,* 1968, 39, pp. 3504-3505.

[4] P. R. Schwoebel, C. E. Holland, C. A. Spindt, J. M. Boone, in 20*th International Vacuum Nanoelectronics Conference,* 2008, p. 67.

[5] I. Brodie, P. R. Schwoebel, *Proc. IEEE,* 1994, 82, pp. 1006-1034.

[6] P. R. Schwoebel, *Appl. Phys. Lett.,* 2006, 88, 113902.

[7] A. Ghis, R. Meyer, P. Rambaud, F. Levy, T. Leroux, *IEEE Trans. Electron Devices,* 1991, 38, pp. 2320-2322.

[8] F. S. Baker, A. R. Osborn, J. Williams, *J. Phys. D,* 1974, 7, pp. 2105-2115.

[9] F. S. Baker, A. R. Osborn, J. Williams, *Nature,* 1972, 239, pp. 96-97.

[10] Ramasamy Pothiraja, Nikita Bibinov, Peter Awakowicz, *J. Phys. D,* 2011, 44, 355206.

[11] M. Meyyappan, "A review of plasma enhanced chemical vapour deposition of carbon nanotubes," J. Phys. D, vol. 42, pp. 213001, 2009.

[12] M. Meyyappan et al, "Carbon nanotube growth by PECVD: a review," Plasma Sources Sci. Technol., vol. 12, pp. 205-216, 2003.

[13] N. Liu, G. Fang, X. Yang, W. Zeng, C. Li, M. Wang, J. Li, X. Zhao, *Diamond Rel. Mater.,* 2009, 18, p. 1375.

[14] X. Calderon-Colon, H. Geng, B. Gao, L. An, G. Cao, O. Zhou, *Nanotechnology,* 2009, 20, 325707.

[15] Teo KBK, Lee S, Chhowalla M, Semet V, Binh V T, Groening O, et al., Plasma enhanced chemical vapour deposition carbon nanotubes/nanofibres—how uniform do they grow?", Nanotechnology, 2003; 14, pp. 204-211.

[16] Purcell S T, Vincent P, Journet C, Binh V T, Hot nanotubes: stable heating of individual multiwall carbon nanotubes to 2000K induced by the field-emission current, Phys Rev Lett., 2002; 88(10), pp. 105502-105505.

The invention claimed is:

1. An electrode field emitter comprising:

a resistive layer having a first surface;

a connection layer having a first surface disposed adjacent to the first surface of the resistive layer, the connection layer being patterned to form a single connection pad; and a single nanostructure element for emitting electrons during use, the single nanostructure element being disposed adjacent to a second surface of the single connection pad that is opposite the first surface of the connection pad, the single nanostructure element having, a diameter that is smaller than a diameter of the single connection pad.

2. The emitter of claim 1, wherein the nanostructure element comprises one of a nanotube emitter, a nanofiber emitter, and a nanowire emitter.

3. The emitter of claim 1, wherein the nanostructure element is made from one of carbon, ZnO, TiO, tungsten and gold.

4. The emitter of claim 1 wherein the nanostructure element has a diameter in the range of about 3 nanometers to about 100 nanometers and a length of about 1 micrometer to about 10 micrometers.

5. The emitter of claim 1, wherein the resistive layer comprises one of a pure semiconductor material, a doped semiconductor material, a metal oxide and combinations thereof.

6. The emitter of claim 1, wherein the resistive layer has a resistivity in the range of about $10^2$ to about $10^5$ ohm·m.

7. The emitter of claim 1, wherein the connection pad has a diameter in the range of about 0.5 micrometers to about 5 micrometers and a thickness in the range of about 10 nanometers to about 300 nanometers.

8. The emitter of claim 1, wherein the emitter further comprises:

a conductive layer forming a first electrode having a first surface adjacent to a second surface of the resistive layer that is opposite the first surface of the resistive layer.

9. The emitter of claim 8, wherein the emitter further comprises a substrate layer that is adjacent to a second surface of the conductive layer that is opposite the first surface of the conductive layer.

10. The emitter of claim 8, wherein the emitter further comprises a gate electrode assembly comprising:

an insulator layer disposed about the nanostructure element; and a cylinder-shaped gate electrode layer disposed about the insulator layer.

11. The emitter of claim 10, wherein the nanostructure element has a tip that is approximately at a center of the gate electrode layer and is coplanar with an upper surface of the gate electrode layer.

12. The emitter of claim 10, wherein the insulator layer comprises one of silicon dioxide, alumina, a ceramic, a polymer and a combination of two or more of these materials.

13. The emitter of claim 10, wherein the connection pad, the conductive layer and the gate electrode layer comprise one of metal, graphene, graphite, Indium tin oxide and aluminum doped zinc, oxide.

14. The emitter of claim 8, wherein the conductive layer has a thickness between about 30 nanometers to about 3 micrometers.

15. The emitter of claim 8, wherein the gate electrode layer has a thickness between about 30 nanometers to at 500 nanometers.

16. The emitter of claim wherein the resistive layer is patterned to the same pattern of the connection pad.

17. The emitter of claim 1, wherein the single connection pad and the resistive layer adjacent the single connection pad act as a current limiter to limit the current of the emitter to protect against an over current condition.

18. A field electron emission device comprising:

a cathode comprising:

a conductive layer forming a first electrode having a first surface and a second surface, a resistive layer having a first surface adjacent to the second surface of the conductive layer;

an emitter array of nanostructure electrode field emitters disposed on a second surface of the resistive layer opposite the first surface of the resistive layer, each field emitter comprising:

a connective layer disposed on the second surface of the resistive layer, the connective layer being patterned to form a single connection pad; and a single nanostructure element for emitting electrons during use, the single nanostructure element being disposed on the single connection pad, the single nanostructure element having a diameter that is smaller than a diameter of the single connection pad; and an anode that is in electrical communication with the cathode during use.

19. The device of claim 18 wherein the device further comprises a substrate layer adjacent to the first surface of the conductive layer.

20. The device of claim 18, wherein the nanostructure element comprises one of a nanotube emitter, a nanofiber emitter and a nanowire emitter.

21. The emitter of claim 18, wherein the nanostructure element is made from one of carbon, ZnO, TiO, tungsten and gold.

22. The device of claim 18, wherein each nanostructure element disposed at or near a center of a corresponding connection pad.

23. The device of claim 18, wherein the device further comprises an array of gate electrode assemblies in which each gate electrode assembly comprises:

an insulator layer disposed about the nanostructure element; and a gate electrode layer disposed about the insulator layer.

24. The device of claim 23, wherein the insulator layer is uniformly coated on the whole cathode with a thickness from about 30 nanometers to about 500 nanometers.

25. The device of claim 23, wherein the gate electrode layer has a cylindrical shape and a corresponding nanostructure element is disposed about a longitudinal axis of the cylindrical shape.

26. The device of claim 23, wherein the tips of the nanostructure elements and an upper surface of the gate electrode layers are self-aligned and have similar heights due to a polishing process.

27. The device of claim 23, wherein the insulator layer comprises one of silicon dioxide, alumina, a ceramic, a polymer and a combination of two or more of these materials.

28. The device of claim 23, wherein the connection pad, the conductive layer and the gate electrode layer comprise one of metal, graphene, graphite, Indium tin oxide, and aluminum doped zinc oxide.

29. The device of claim 23, wherein the gate electrode layer, has a thickness between of about 30 nanometers to about 500 nanometers.

30. The device of claim 18, wherein the conductive layer has a thickness between about 30 nanometers to about 3 micrometers.

31. The device of claim 18, wherein each nanostructure element has a diameter in the range of about 3 nanometers to about 100 nanometers and a length of about 1 micrometer to about 10 micrometers.

32. The device of claim 18, wherein the resistive layer comprises one of a pure semiconductor material, a doped semiconductor material, a metal oxide and combinations thereof.

33. The device of claim 18, wherein the resistive layer has a resistivity in the range of about $10^2$ to about 10 ohm·m.

34. The device of claim 18, wherein the connection pads have diameters in the range of about 0.5 micrometers to about 5 micrometers and a thickness in the range of about 10 nanometers to about 300 nanometers.

35. The device of claim 18, wherein the resistive layer is patterned to the same pattern of the connection pad.

36. The device of claim 18, wherein the single connection pad and the resistive layer adjacent the single, connection pad act as a current limiter to limit the current of each nanostructure electrode field emitter to protect against an over current condition.

37. A method of forming an electrode field emitter, the method comprising:

forming a resistive layer with a flat surface;

forming a single connection pad on the resistive layer;

forming a single catalyst dot on the single connection pad; and growing a single nanostructure element at approximately a center of the single connection pad, the single nanostructure element being used for emitting electrons during use, the single nanostructure element being grown to have a diameter that is smaller than a diameter of the single connection pad.

38. The method of claim 37, wherein the method further comprises:

forming an insulation layer about the single, nanostructure element, the single connection pad and the resistive layer;

forming a conductive layer about the insulation layer;

forming a support layer about the conductive layer;

polishing an upper surface of the support layer until a flat conductive surface and a tip of the single nanostructure element emerges, the flat conductive surface being a top surface of a gate electrode layer; and removing a portion of the support layer disposed around the gate electrode layer and a portion of the insulation layer disposed around the tip of the single nanostructure to form a coaxial gate electrode assembly.

39. The method of claim 37, wherein the method further comprises configuring the single connection pad and the resistive layer adjacent the single connection pad to act as a current limiter to limit the current of the electrode field emitter to protect against an over current condition.

* * * * *